US010290251B2

(12) United States Patent
Park et al.

(10) Patent No.: US 10,290,251 B2
(45) Date of Patent: May 14, 2019

(54) METHOD OF DRIVING DISPLAY PANEL AND DISPLAY APPARATUS FOR PERFORMING THE SAME

(71) Applicant: SAMSUNG DISPLAY CO., LTD., Yongin-si, Gyeonggi-do (KR)

(72) Inventors: Minwook Park, Hwaseong-si (KR); Jinyoung Lee, Suwon-si (KR); Seung-Won Kuk, Cheonan-si (KR); Yunjae Park, Seoul (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 71 days.

(21) Appl. No.: 15/593,161

(22) Filed: May 11, 2017

(65) Prior Publication Data

US 2018/0012531 A1 Jan. 11, 2018

(30) Foreign Application Priority Data

Jul. 7, 2016 (KR) ..... 10-2016-0086277

(51) Int. Cl.
*G09G 5/00* (2006.01)
*G09G 3/20* (2006.01)
(Continued)

(52) U.S. Cl.
CPC ..... *G09G 3/2003* (2013.01); *G09G 3/3677* (2013.01); *G09G 5/02* (2013.01);
(Continued)

(58) Field of Classification Search
CPC ..... G09G 3/2003; G09G 3/3677; G09G 5/02; G09G 2310/04; G09G 2310/0286;
(Continued)

(56) References Cited

U.S. PATENT DOCUMENTS

2008/0316159 A1 12/2008 Qi
2012/0293568 A1* 11/2012 Todorovich ..... G09G 3/3466 345/690
(Continued)

FOREIGN PATENT DOCUMENTS

JP 2012-173499 9/2012
KR 10-0160199 8/1998
(Continued)

OTHER PUBLICATIONS

Extended European Search Report dated Nov. 8, 2017 for European Application No. 17179700.4.

*Primary Examiner* — Jonathan A Boyd
(74) *Attorney, Agent, or Firm* — F. Chau Associates, LLC

(57) ABSTRACT

A display apparatus includes a display panel having a plurality of gate lines, a plurality of data lines, and a plurality of subpixels. Each of the plurality of subpixels includes a subpixel electrode connected to one of the plurality of gate lines and one of the plurality of data lines through a switching element. A gate driver is configured to output a plurality of gate signals to the plurality of gate lines and to deactivate at least one of the plurality of gate signals in a P-th frame. A data driver is configured to output a plurality of data voltages to the plurality of data lines. Here, P is a positive integer.

21 Claims, 26 Drawing Sheets

(51) Int. Cl.
*G09G 5/02* (2006.01)
*G09G 3/36* (2006.01)

(52) U.S. Cl.
CPC ..... *G09G 2300/0452* (2013.01); *G09G 2300/0852* (2013.01); *G09G 2310/0227* (2013.01); *G09G 2310/0267* (2013.01); *G09G 2310/0286* (2013.01); *G09G 2310/04* (2013.01); *G09G 2310/08* (2013.01); *G09G 2320/0247* (2013.01); *G09G 2320/0252* (2013.01); *G09G 2320/0673* (2013.01); *G09G 2320/103* (2013.01); *G09G 2340/16* (2013.01)

(58) Field of Classification Search
CPC ... G09G 2310/0267; G09G 2310/0227; G09G 2320/103; G09G 2340/16; G09G 2320/0673; G09G 2310/08; G09G 2300/0852; G09G 2300/0452
See application file for complete search history.

(56) References Cited

U.S. PATENT DOCUMENTS

2013/0293529 A1* 11/2013 You ..... G09G 3/20 345/212
2014/0225877 A1* 8/2014 Nakanishi ..... G09G 3/3648 345/204
2014/0253837 A1 9/2014 Chang et al.
2014/0320478 A1* 10/2014 Oh ..... G09G 3/00 345/212
2015/0235600 A1 8/2015 Inada et al.
2015/0348508 A1 12/2015 Her

FOREIGN PATENT DOCUMENTS

KR 1020040006251 1/2004
KR 1020050067799 7/2005
KR 1020070100992 10/2007
KR 1020080024755 3/2008
KR 1020150038949 4/2015
KR 1020150062968 6/2015

* cited by examiner

FIG. 13

100A

| | | | | | | | | | |
|---|---|---|---|---|---|---|---|---|---|
| GL1 | R | R | R | R | R | R | R | R | R |
| GL2 | G | G | G | G | G | G | G | G | G |
| GL3 | B | B | B | B | B | B | B | B | B |
| GL4 | R | R | R | R | R | R | R | R | R |
| GL5 | G | G | G | G | G | G | G | G | G |
| GL6 | B | B | B | B | B | B | B | B | B |
| GL7 | R | R | R | R | R | R | R | R | R |
| GL8 | G | G | G | G | G | G | G | G | G |
| GL9 | B | B | B | B | B | B | B | B | B |
| GL10 | R | R | R | R | R | R | R | R | R |
| GL11 | G | G | G | G | G | G | G | G | G |
| GL12 | B | B | B | B | B | B | B | B | B |

FIG. 14A

100A

| | | | | | | | | | |
|---|---|---|---|---|---|---|---|---|---|
| GL1 | R | R | R | R | R | R | R | R | R |
| GL2 | G | G | G | G | G | G | G | G | G |
| GL3 | B | B | B | B | B | B | B | B | B |
| GL4 | R | R | R | R | R | R | R | R | R |
| GL5 | G | G | G | G | G | G | G | G | G |
| GL6 | B | B | B | B | B | B | B | B | B |
| GL7 | R | R | R | R | R | R | R | R | R |
| GL8 | G | G | G | G | G | G | G | G | G |
| GL9 | B | B | B | B | B | B | B | B | B |
| GL10 | R | R | R | R | R | R | R | R | R |
| GL11 | G | G | G | G | G | G | G | G | G |
| GL12 | B | B | B | B | B | B | B | B | B |

FIG. 14D

100A

| | | | | | | | | | |
|---|---|---|---|---|---|---|---|---|---|
| GL1 | R | R | R | R | R | R | R | R | R |
| GL2 | G | G | G | G | G | G | G | G | G |
| GL3 | B | B | B | B | B | B | B | B | B |
| GL4 | R | R | R | R | R | R | R | R | R |
| GL5 | G | G | G | G | G | G | G | G | G |
| GL6 | B | B | B | B | B | B | B | B | B |
| GL7 | R | R | R | R | R | R | R | R | R |
| GL8 | G | G | G | G | G | G | G | G | G |
| GL9 | B | B | B | B | B | B | B | B | B |
| GL10 | R | R | R | R | R | R | R | R | R |
| GL11 | G | G | G | G | G | G | G | G | G |
| GL12 | B | B | B | B | B | B | B | B | B |

FIG. 14E

100A

| | | | | | | | | | |
|---|---|---|---|---|---|---|---|---|---|
| GL1 | R | R | R | R | R | R | R | R | R |
| GL2 | G | G | G | G | G | G | G | G | G |
| GL3 | B | B | B | B | B | B | B | B | B |
| GL4 | R | R | R | R | R | R | R | R | R |
| GL5 | G | G | G | G | G | G | G | G | G |
| GL6 | B | B | B | B | B | B | B | B | B |
| GL7 | R | R | R | R | R | R | R | R | R |
| GL8 | G | G | G | G | G | G | G | G | G |
| GL9 | B | B | B | B | B | B | B | B | B |
| GL10 | R | R | R | R | R | R | R | R | R |
| GL11 | G | G | G | G | G | G | G | G | G |
| GL12 | B | B | B | B | B | B | B | B | B |

FIG. 14F

100A

| | | | | | | | | | |
|---|---|---|---|---|---|---|---|---|---|
| GL1 | R | R | R | R | R | R | R | R | R |
| GL2 | G | G | G | G | G | G | G | G | G |
| GL3 | B | B | B | B | B | B | B | B | B |
| GL4 | R | R | R | R | R | R | R | R | R |
| GL5 | G | G | G | G | G | G | G | G | G |
| GL6 | B | B | B | B | B | B | B | B | B |
| GL7 | R | R | R | R | R | R | R | R | R |
| GL8 | G | G | G | G | G | G | G | G | G |
| GL9 | B | B | B | B | B | B | B | B | B |
| GL10 | R | R | R | R | R | R | R | R | R |
| GL11 | G | G | G | G | G | G | G | G | G |
| GL12 | B | B | B | B | B | B | B | B | B |

FIG. 14G

100A

| | | | | | | | | | |
|---|---|---|---|---|---|---|---|---|---|
| GL1 | R | R | R | R | R | R | R | R | R |
| GL2 | G | G | G | G | G | G | G | G | G |
| GL3 | B | B | B | B | B | B | B | B | B |
| GL4 | R | R | R | R | R | R | R | R | R |
| GL5 | G | G | G | G | G | G | G | G | G |
| GL6 | B | B | B | B | B | B | B | B | B |
| GL7 | R | R | R | R | R | R | R | R | R |
| GL8 | G | G | G | G | G | G | G | G | G |
| GL9 | B | B | B | B | B | B | B | B | B |
| GL10 | R | R | R | R | R | R | R | R | R |
| GL11 | G | G | G | G | G | G | G | G | G |
| GL12 | B | B | B | B | B | B | B | B | B |

FIG. 15A

100A

| | | | | | | | | | |
|---|---|---|---|---|---|---|---|---|---|
| GL1 | R | R | R | R | R | R | R | R | R |
| GL2 | G | G | G | G | G | G | G | G | G |
| GL3 | B | B | B | B | B | B | B | B | B |
| GL4 | R | R | R | R | R | R | R | R | R |
| GL5 | G | G | G | G | G | G | G | G | G |
| GL6 | B | B | B | B | B | B | B | B | B |
| GL7 | R | R | R | R | R | R | R | R | R |
| GL8 | G | G | G | G | G | G | G | G | G |
| GL9 | B | B | B | B | B | B | B | B | B |
| GL10 | R | R | R | R | R | R | R | R | R |
| GL11 | G | G | G | G | G | G | G | G | G |
| GL12 | B | B | B | B | B | B | B | B | B |

FIG. 15B

100A

| | | | | | | | | | |
|---|---|---|---|---|---|---|---|---|---|
| GL1 | R | R | R | R | R | R | R | R | R |
| GL2 | G | G | G | G | G | G | G | G | G |
| GL3 | B | B | B | B | B | B | B | B | B |
| GL4 | R | R | R | R | R | R | R | R | R |
| GL5 | G | G | G | G | G | G | G | G | G |
| GL6 | B | B | B | B | B | B | B | B | B |
| GL7 | R | R | R | R | R | R | R | R | R |
| GL8 | G | G | G | G | G | G | G | G | G |
| GL9 | B | B | B | B | B | B | B | B | B |
| GL10 | R | R | R | R | R | R | R | R | R |
| GL11 | G | G | G | G | G | G | G | G | G |
| GL12 | B | B | B | B | B | B | B | B | B |

FIG. 15C

100A

| | | | | | | | | | |
|---|---|---|---|---|---|---|---|---|---|
| GL1 | R | R | R | R | R | R | R | R | R |
| GL2 | G | G | G | G | G | G | G | G | G |
| GL3 | B | B | B | B | B | B | B | B | B |
| GL4 | R | R | R | R | R | R | R | R | R |
| GL5 | G | G | G | G | G | G | G | G | G |
| GL6 | B | B | B | B | B | B | B | B | B |
| GL7 | R | R | R | R | R | R | R | R | R |
| GL8 | G | G | G | G | G | G | G | G | G |
| GL9 | B | B | B | B | B | B | B | B | B |
| GL10 | R | R | R | R | R | R | R | R | R |
| GL11 | G | G | G | G | G | G | G | G | G |
| GL12 | B | B | B | B | B | B | B | B | B |

FIG. 15D

100A

| | | | | | | | | | |
|---|---|---|---|---|---|---|---|---|---|
| GL1 | R | R | R | R | R | R | R | R | R |
| GL2 | G | G | G | G | G | G | G | G | G |
| GL3 | B | B | B | B | B | B | B | B | B |
| GL4 | R | R | R | R | R | R | R | R | R |
| GL5 | G | G | G | G | G | G | G | G | G |
| GL6 | B | B | B | B | B | B | B | B | B |
| GL7 | R | R | R | R | R | R | R | R | R |
| GL8 | G | G | G | G | G | G | G | G | G |
| GL9 | B | B | B | B | B | B | B | B | B |
| GL10 | R | R | R | R | R | R | R | R | R |
| GL11 | G | G | G | G | G | G | G | G | G |
| GL12 | B | B | B | B | B | B | B | B | B |

METHOD OF DRIVING DISPLAY PANEL AND DISPLAY APPARATUS FOR PERFORMING THE SAME

PRIORITY STATEMENT

This application claims priority under 35 U.S.C. § 119 to Korean Patent Application No. 10-2016-0086277, filed on Jul. 7, 2016 in the Korean Intellectual Property Office KIPO, the contents of which are herein incorporated by reference in their entireties.

TECHNICAL FIELD

Exemplary embodiments of the present inventive concept relate to a display panel, and more particularly, exemplary embodiments of the present inventive concept relate to a method of driving a display panel and a display apparatus for performing the method.

DISCUSSION OF THE RELATED ART

Generally, a display apparatus includes a display panel and a display panel driver. The display panel includes a plurality of gate lines, a plurality of data lines and a plurality of subpixels. The display panel driver includes a gate driver providing gate signals to the gate lines and a data driver providing data voltages to the data lines.

As a size of the display panel increases and a driving frequency of the display panel increases, a charging time required to charge the subpixels to the data voltage may decrease.

SUMMARY

A display apparatus includes a display panel having a plurality of gate lines, a plurality of data lines, and a plurality of subpixels. Each of the plurality of subpixels includes a subpixel electrode connected to one of the plurality of gate lines and one of the plurality of data lines through a switching element. A gate driver is configured to output a plurality of gate signals to the plurality of gate lines and to deactivate at least one of the plurality of gate signals in a P-th frame. A data driver is configured to output a plurality of data voltages to the plurality of data lines. Here, P is a positive integer.

A method of driving a display panel includes deactivating at least one gate signal of a plurality of gate signals in a P-th frame. Activated gate signals of the plurality of gate signals are applied to a plurality of gate lines. A plurality of data voltages is applied to a plurality of data lines. An image is displayed based on the plurality of gate signals and the plurality of data voltages. Here, P is a positive integer.

BRIEF DESCRIPTION OF THE DRAWINGS

The above and other features and aspects of the present inventive concept will become more apparent by describing in detailed exemplary embodiments thereof with reference to the accompanying drawings, in which:

FIG. 13 is a conceptual diagram illustrating a display panel according to an exemplary embodiment of the present inventive concept;

FIG. 14A is a conceptual diagram illustrating a method of driving the display panel of FIG. 13 during a P-th frame, according to an exemplary embodiment of the present inventive concept;

FIG. 14D is a conceptual diagram illustrating a method of driving the display panel of FIG. 13 during a (P+3)-th frame, according to an exemplary embodiment of the present inventive concept;

FIG. 14E is a conceptual diagram illustrating a method of driving the display panel of FIG. 13 during a (P+4)-th frame, according to an exemplary embodiment of the present inventive concept;

FIG. 14F is a conceptual diagram illustrating a method of driving the display panel of FIG. 13 during a (P+5)-th frame, according to an exemplary embodiment of the present inventive concept;

FIG. 14G is a conceptual diagram illustrating a method of driving the display panel of FIG. 13 during a (P+6)-th frame, according to an exemplary embodiment of the present inventive concept;

FIG. 15A is a conceptual diagram illustrating a method of driving a display panel, according to an exemplary embodiment of the present inventive concept, during a P-th frame;

FIG. 15B is a conceptual diagram illustrating a method of driving the display panel of FIG. 15A during a (P+1)-th frame, according to an exemplary embodiment of the present inventive concept;

FIG. 15C is a conceptual diagram illustrating a method of driving the display panel of FIG. 15A during a (P+2)-th frame, according to an exemplary embodiment of the present inventive concept; and FIG. 15D is a conceptual diagram illustrating a method of driving the display panel of FIG. 15A during a (P+3)-th frame, according to an exemplary embodiment of the present inventive concept.

DETAILED DESCRIPTION OF THE INVENTIVE CONCEPT

Hereinafter, exemplary embodiments of the present inventive concept will be explained in detail with reference to the accompanying drawings.

Figure 1:
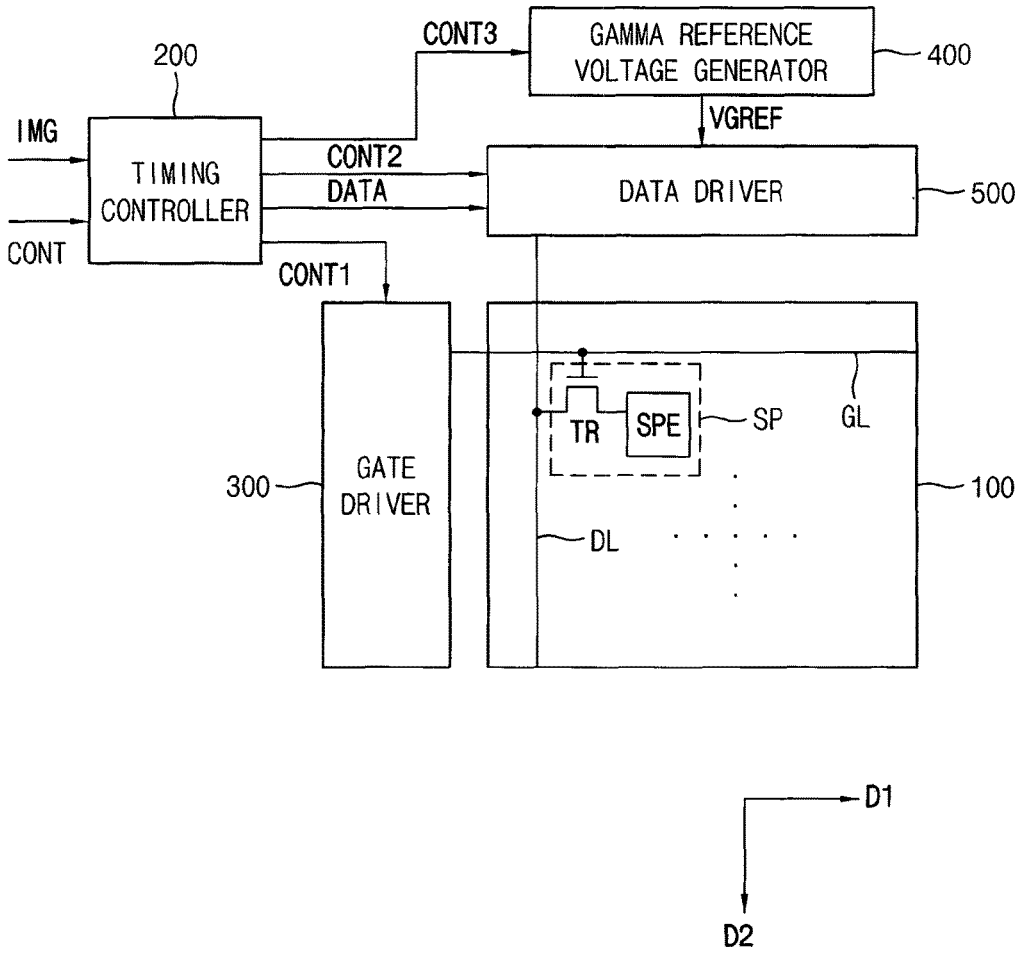
FIG. 1 is a block diagram illustrating a display apparatus, according to an exemplary embodiment of the present inventive concept.

FIG. 1 is a block diagram illustrating a display apparatus, according to an exemplary embodiment of the present inventive concept.

Referring to FIG. 1, the display apparatus includes a display panel 100 and a display panel driver. The display panel driver includes a timing controller 200, a gate driver 300, a gamma reference voltage generator 400 and a data driver 500.

The display panel 100 has a display region on which an image is displayed and a peripheral region, on which an image is not displayed, adjacent to the display region.

The display panel 100 includes a plurality of gate lines GL, a plurality of data lines DL, and a plurality of subpixels SP connected to the gate lines GL and the data lines DL. The gate lines GL extend in a first direction D1 and the data lines DL extend in a second direction D2 crossing the first direction D1.

Each subpixel SP includes a switching element TR and a subpixel electrode SPE connected to the switching element TR. The subpixel electrode SPE is connected to one of the gate lines GL and one of the data lines DL through the switching element TR. Each subpixel SP may further include a liquid crystal capacitor, and a storage capacitor. The liquid crystal capacitor and the storage capacitor are electrically connected to the switching element TR. The subpixels may be disposed in a matrix form.

The display panel 100 is further described below with reference to FIGS. 2 to 3D.

The timing controller 200 receives input image data IMG and an input control signal CONT from an external source. The input image data may include red image data, green image data, and blue image data. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3, and a data signal DATA based on the input image data IMG and the input control signal CONT.

The timing controller 200 generates the first control signal CONT1 for controlling an operation of the gate driver 300 based on the input control signal CONT, and outputs the first control signal CONT1 to the gate driver 300. The first control signal CONT1 may include a driving mode signal. The first control signal CONT1 may further include a vertical start signal and a gate clock signal.

The timing controller 200 generates the second control signal CONT2 for controlling an operation of the data driver 500 based on the input control signal CONT, and outputs the second control signal CONT2 to the data driver 500. The second control signal CONT2 may include the driving mode signal. The second control signal CONT2 may further include a horizontal start signal and a load signal.

The timing controller 200 generates the data signal DATA based on the input image data IMG. The timing controller 200 outputs the data signal DATA to the data driver 500.

The timing controller 200 generates the third control signal CONT3 for controlling an operation of the gamma reference voltage generator 400 based on the input control signal CONT, and outputs the third control signal CONT3 to the gamma reference voltage generator 400.

Figure 8A:
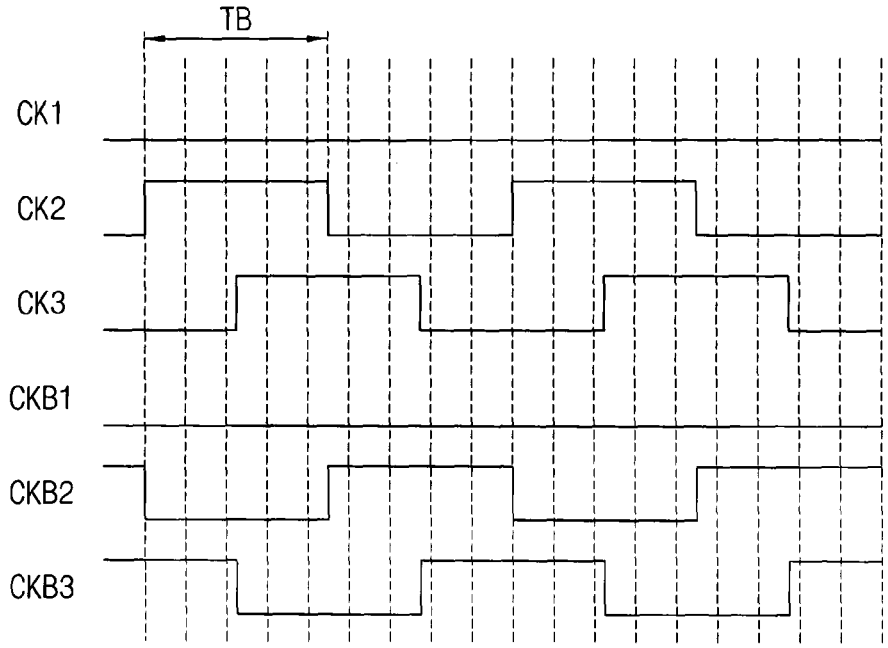
FIG. 8A is a timing diagram illustrating clock signals applied to the gate driver of FIG. 1 during the P-th frame when the gate driver of FIG. 1 operates "three line skip" driving, according to an exemplary embodiment of the present inventive concept.
Figure 8B:
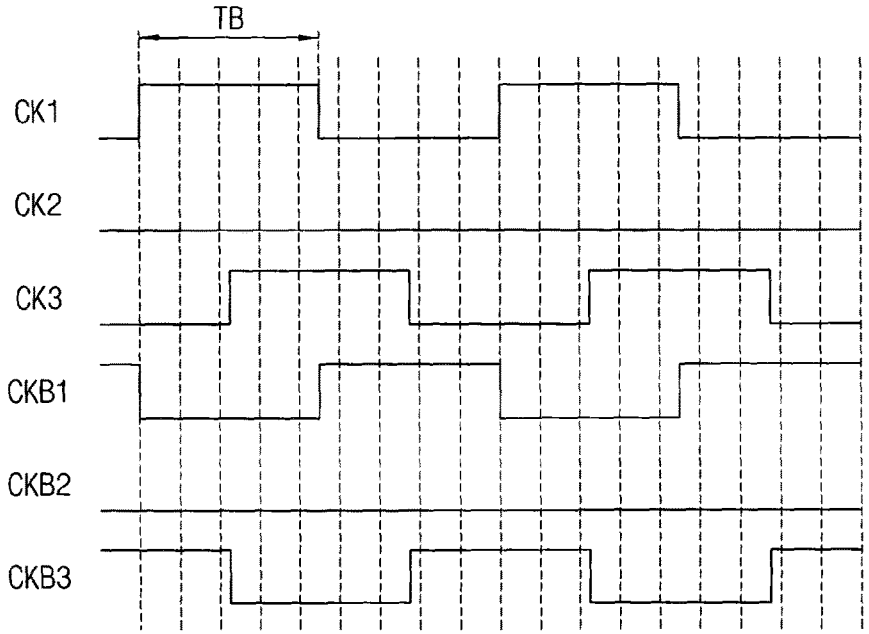
FIG. 8B is a timing diagram illustrating clock signals applied to the gate driver of FIG. 1 during the (P+1)-th frame when the gate driver of FIG. 1 operates the "three line skip" driving, according to an exemplary embodiment of the present inventive concept.
Figure 8C:
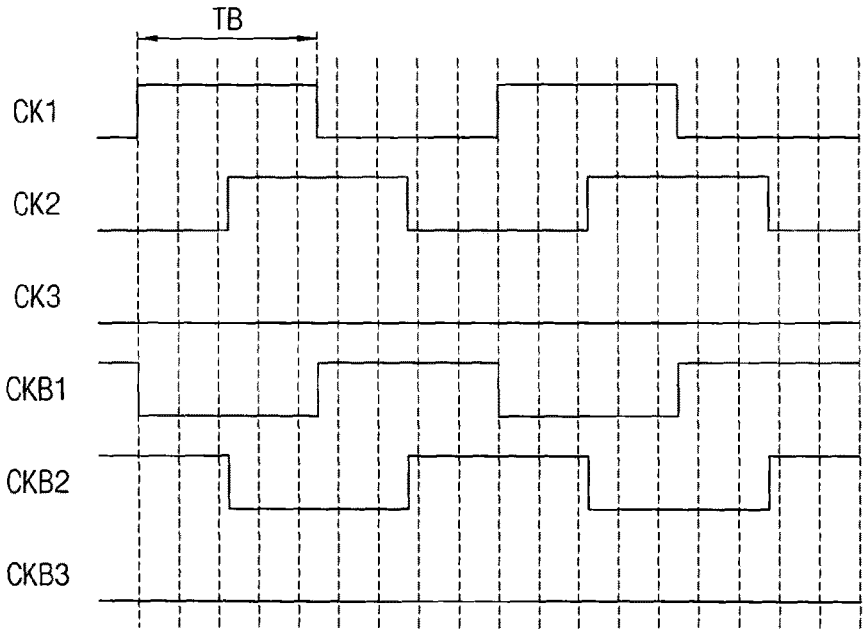
FIG. 8C is a timing diagram illustrating clock signals applied to the gate driver of FIG. 1 during the (P+2)-th frame when the gate driver of FIG. 1 operates the "three line skip" driving, according to an exemplary embodiment of the present inventive concept.
Figure 8D:
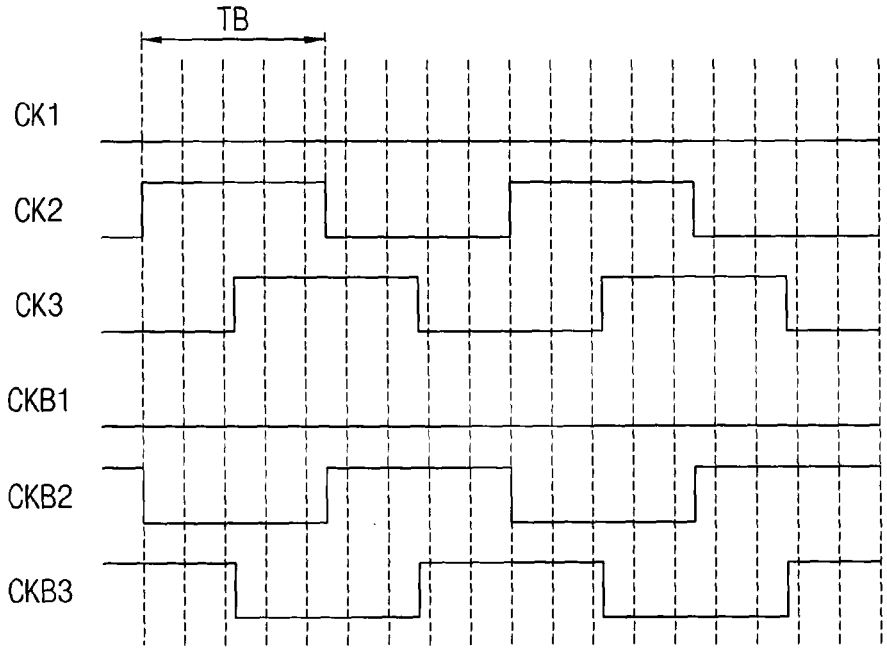
FIG. 8D is a timing diagram illustrating clock signals applied to the gate driver of FIG. 1 during the (P+3)-th frame when the gate driver of FIG. 1 operates the "three line skip" driving, according to an exemplary embodiment of the present inventive concept.
Figure 9:
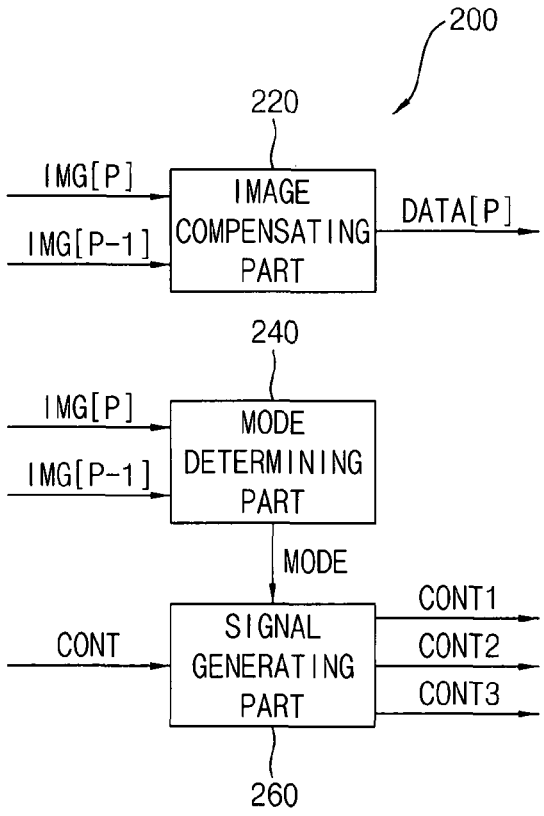
FIG. 9 is a block diagram illustrating a timing controller of FIG. 1, according to an exemplary embodiment of the present inventive concept.

A structure and an operation of the timing controller 200 are further explained below referring to FIGS. 7 to 9.

The gate driver 300 generates gate signals for driving the gate lines GL in response to the first control signal CONT1 received from the timing controller 200. The gate driver 300 sequentially outputs the gate signals to the gate lines GL.

The gate driver 300 may deactivate at least one gate signal during a P-th frame. Herein, P is a positive integer.

The gate driver 300 may include a plurality of stages. The stages may be connected to at least one clock line providing a clock signal. The clock signal applied to the stage, which is connected to the gate line having the deactivated gate signal, may be deactivated.

The gate signal, which is deactivated during the P-th frame, may be activated during a (P+K)-th frame. In addition, at least one gate signal, which is activated during the P-th frame, may be deactivated during the (P+K)-th frame. Herein, K is a positive integer. As explained above, the gate signal that is deactivated changes according to a frame so that a deactivated line in the display panel 100 might not be recognized by an observer.

A structure and an operation of the gate driver 300 are further explained below with reference to FIGS. 4 to 6.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to a level of the data signal DATA.

According to an exemplary embodiment of the present invention, the gamma reference voltage generator 400 may be disposed in the timing controller 200, or in the data driver 500.

The data driver 500 receives the second control signal CONT2 and the data signal DATA from the timing controller 200, and receives the gamma reference voltages VGREF from the gamma reference voltage generator 400. The data driver 500 converts the data signal DATA into analog data voltages using the gamma reference voltages VGREF. The data driver 500 outputs the data voltages to the data lines DL.

Figure 2:
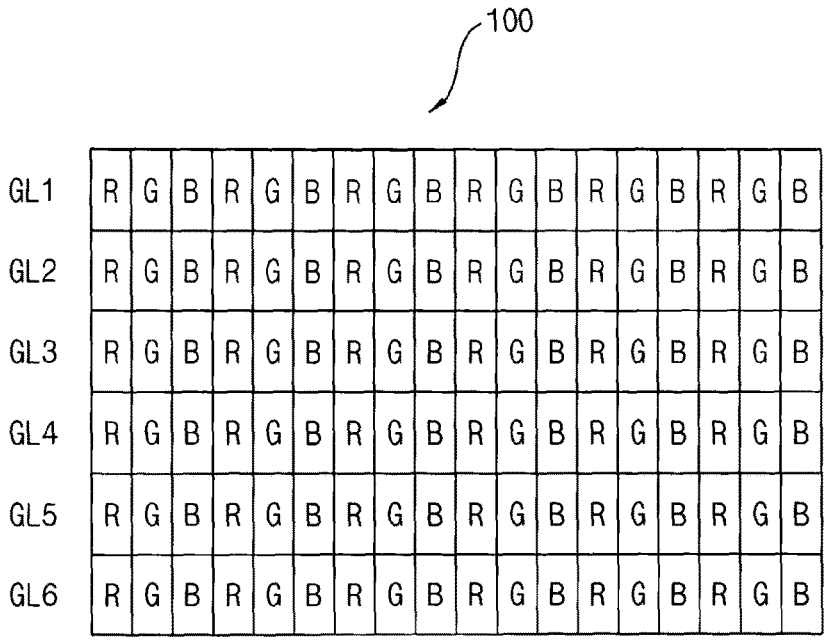
FIG. 2 is a conceptual diagram illustrating a display panel of FIG. 1, according to an exemplary embodiment of the present inventive concept.
Figure 3A:
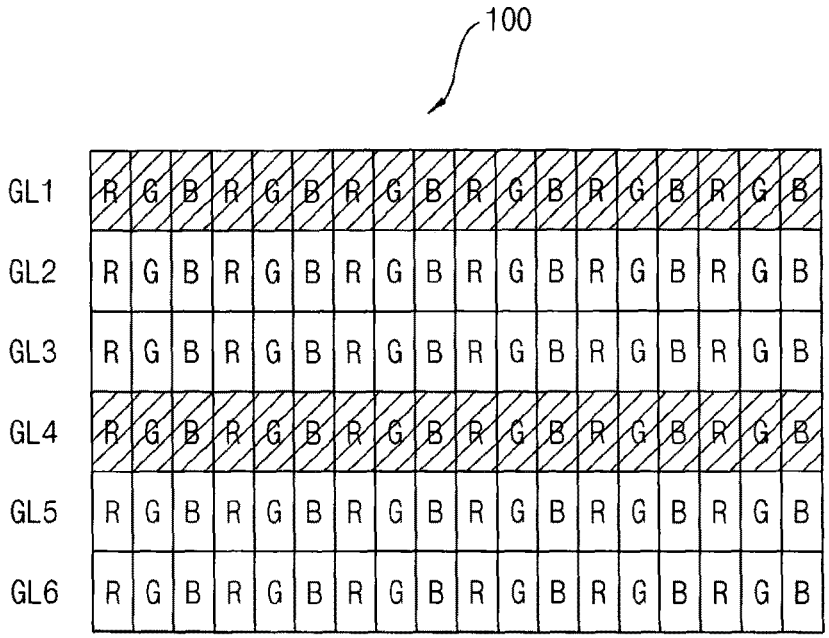
FIG. 3A is a conceptual diagram illustrating a method of driving the display panel of FIG. 1 during a P-th frame, according to an exemplary embodiment of the present inventive concept.
Figure 3B:
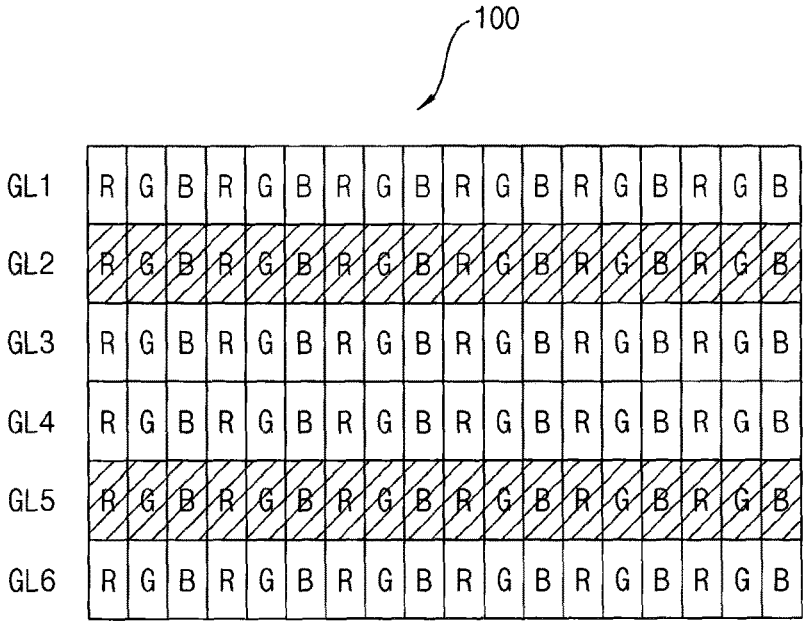
FIG. 3B is a conceptual diagram illustrating a method of driving the display panel of FIG. 1 during a (P+1)-th frame, according to an exemplary embodiment of the present inventive concept.
Figure 3C:
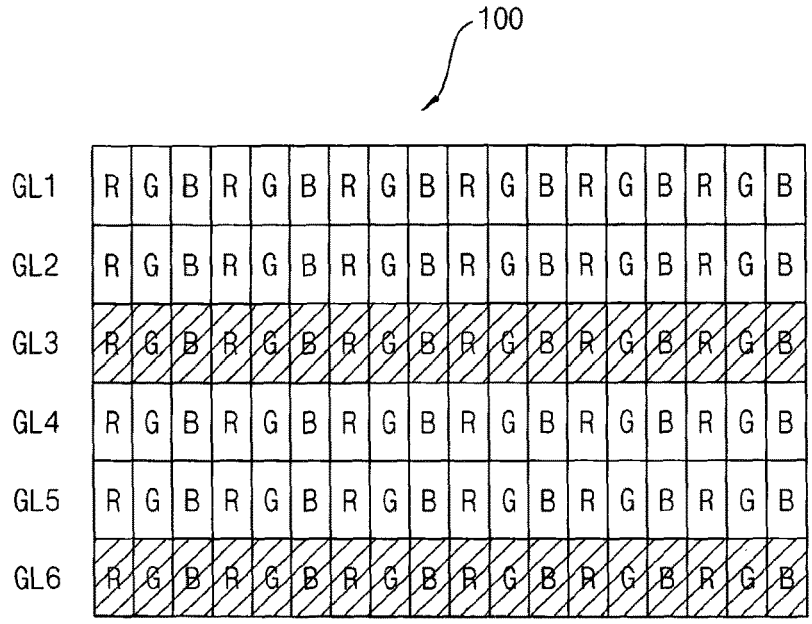
FIG. 3C is a conceptual diagram illustrating a method of driving the display panel of FIG. 1 during a (P+2)-th frame, according to an exemplary embodiment of the present inventive concept.
Figure 3D:
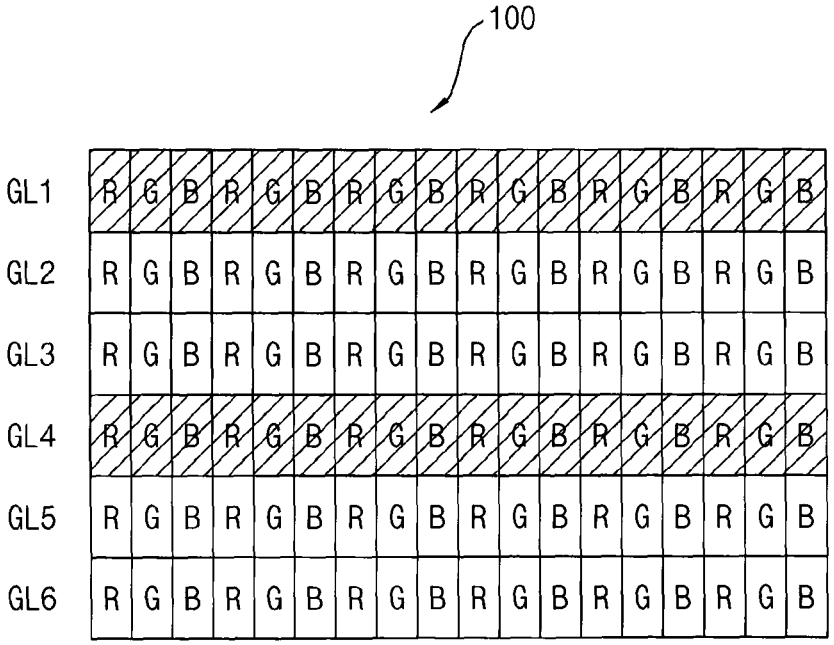
FIG. 3D is a conceptual diagram illustrating a method of driving the display panel of FIG. 1 during a (P+3)-th frame, according to an exemplary embodiment of the present inventive concept.

FIG. 2 is a conceptual diagram illustrating the display panel 100 of FIG. 1. FIG. 3A is a conceptual diagram illustrating a method of driving the display panel 100 of FIG. 1 during a P-th frame. FIG. 3B is a conceptual diagram illustrating a method of driving the display panel 100 of FIG. 1 during a (P+1)-th frame. FIG. 3C is a conceptual diagram illustrating a method of driving the display panel 100 of FIG. 1 during a (P+2)-th frame. FIG. 3D is a conceptual diagram illustrating a method of driving the display panel 100 of FIG. 1 during a (P+3)-th frame. In FIGS. 2 to 3D, only a part of the display panel 100 is shown for convenience of explanation.

Referring to FIGS. 1 to 3D, the display panel 100 includes a plurality of subpixels disposed in a matrix form. The display panel 100 may include a first subpixel having a first color, a second subpixel having a second color, and a third subpixel having a third color. Together, these three subpixels may be said to form a pixel. For example, the first color may be red R. For example, the second color may be green G. For example, the third color may be blue B. However, other combinations of sub-pixels may be used.

According to an exemplary embodiment of the present invention, the first subpixel having the first color R, the second subpixel having the second color G and the third subpixel having the third color B are alternately disposed along a row direction and the subpixels having the same colors are disposed along a column direction in the display panel 100.

In the display panel 100, a first subpixel row is connected to a first gate line GL1, a second subpixel row is connected to a second gate line GL2, a third subpixel row is connected to a third gate line GL3, a fourth subpixel row is connected to a fourth gate line GL4, a fifth subpixel row is connected to a fifth gate line GL5 and a sixth subpixel row is connected to a sixth gate line GL6.

According to an exemplary embodiment of the present invention, the display panel 100 is driven in "three line skip" driving. This may mean that every $3^{rd}$ gate line is deactivated at each frame. According to this driving approach, during the P-th frame, gate signals applied to a first group of gate lines are deactivated. During the (P+1)-th frame, gate signals applied to a second group of gate lines are deactivated. During the (P+2)-th frame, gate signals applied to a third group of gate lines are deactivated.

For example, the first group of gate lines may be (3M−2)-th gate lines. Herein, M is a positive integer. The first group of gate lines may include the first gate line GL1 and the fourth gate line GL4.

For example, the second group of gate lines may be (3M−1)-th gate lines. The second group of gate lines may include the second gate line GL2 and the fifth gate line GL5.

For example, the third group of gate lines may be 3M-th gate lines. The third group of gate lines may include the third gate line GL3 and the sixth gate line GL6.

The number of the first group of gate lines may be less than a half of the number of all gate lines of the display panel 100. The number of the second group of gate lines may be less than a half of the number of all gate lines of the display panel 100. The number of the third group of gate lines may be less than a half of the number of all gate lines of the display panel 100. For example, the number of the first group of gate lines may be substantially the same as the number of the second group of gate lines. For example, the number of the first group of gate lines may be substantially the same as the number of the third group of gate lines.

According to an exemplary embodiment of the present invention, the number of the first group of gate lines may be ⅓ of all gate lines of the display panel 100.

Figure 4:
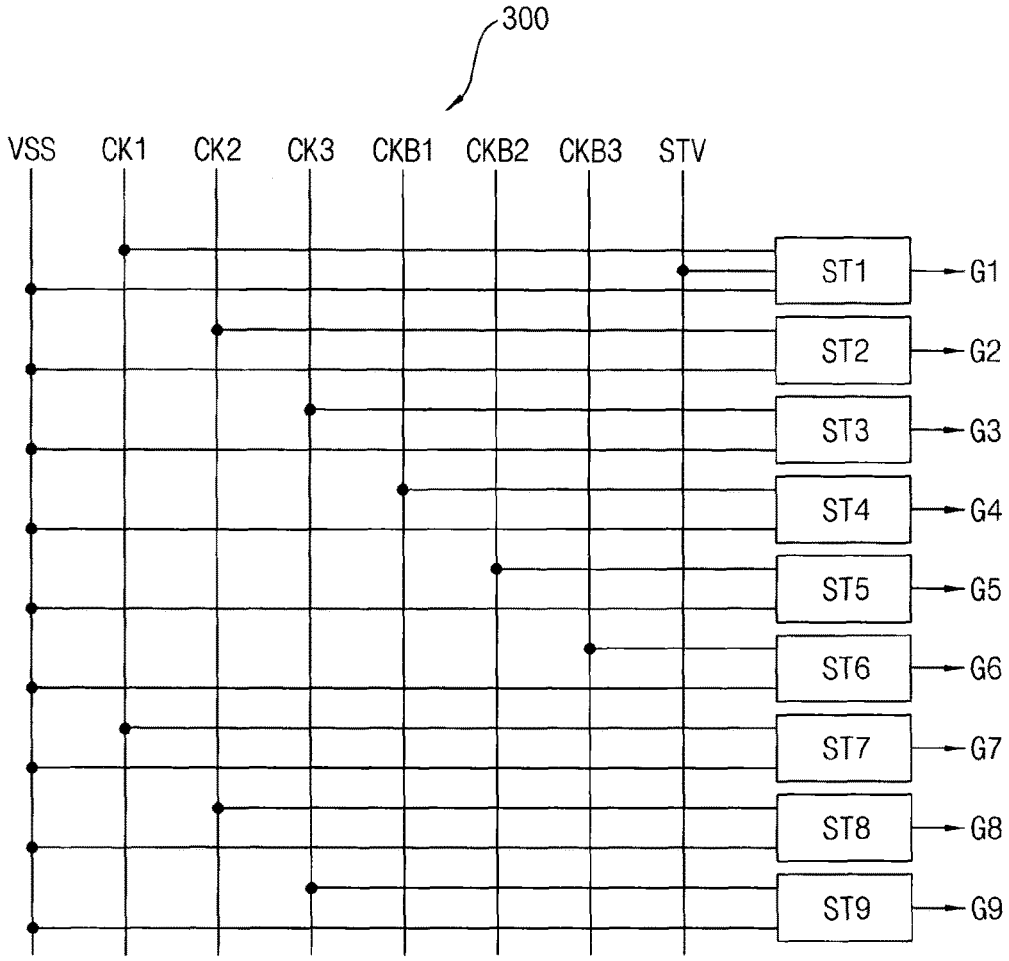
FIG. 4 is a conceptual diagram illustrating a gate driver of FIG. 1 according to an exemplary embodiment of the present inventive concept.
Figure 5A:
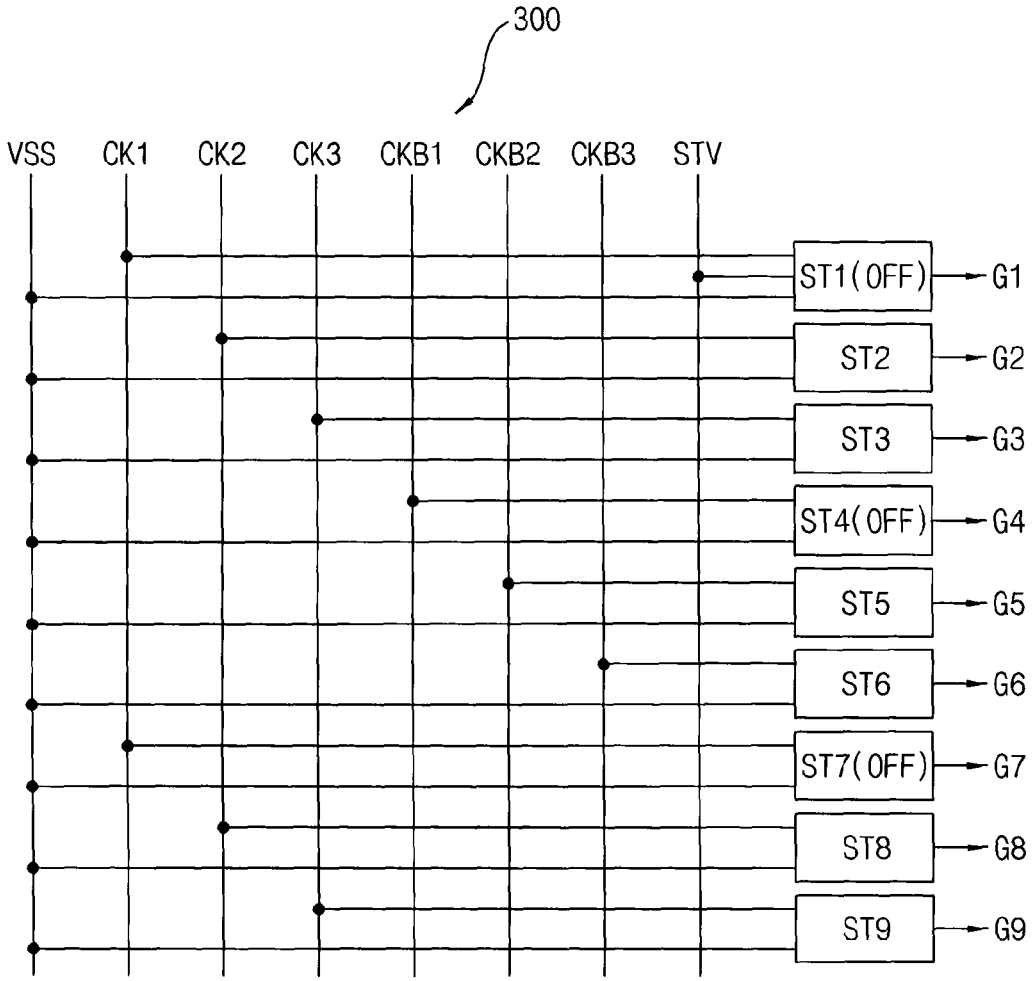
FIG. 5A is a conceptual diagram illustrating an operation of the gate driver of FIG. 4 during the P-th frame, according to an exemplary embodiment of the present inventive concept.
Figure 5B:
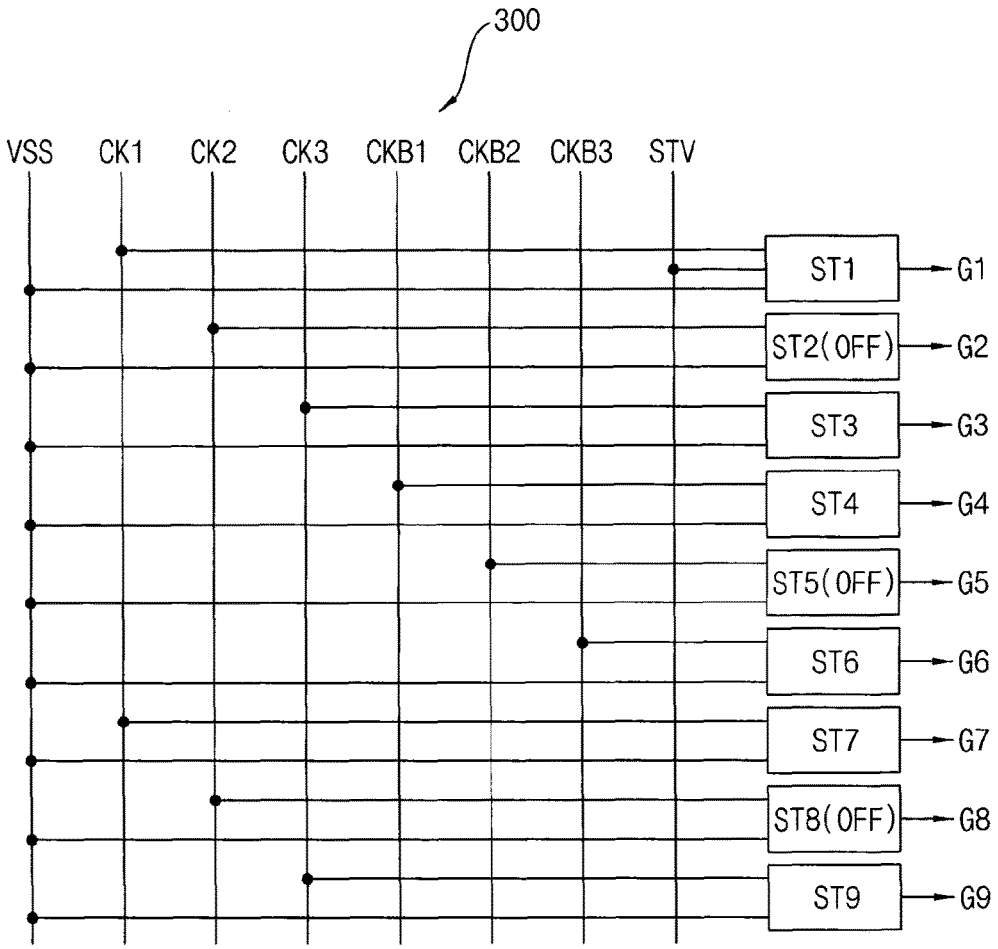
FIG. 5B is a conceptual diagram illustrating an operation of the gate driver of FIG. 4 during the (P+1)-th frame, according to an exemplary embodiment of the present inventive concept.
Figure 5C:
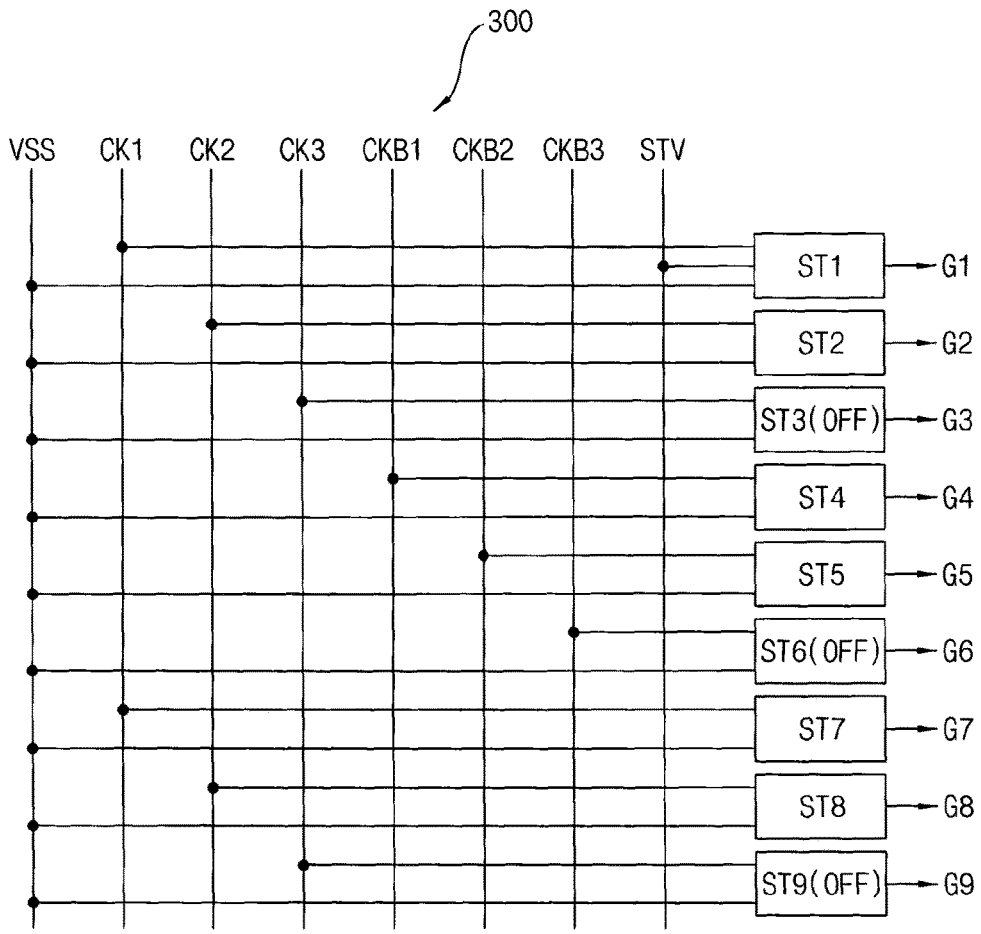
FIG. 5C is a conceptual diagram illustrating an operation of the gate driver of FIG. 4 during the (P+2)-th frame, according to an exemplary embodiment of the present inventive concept.
Figure 5D:
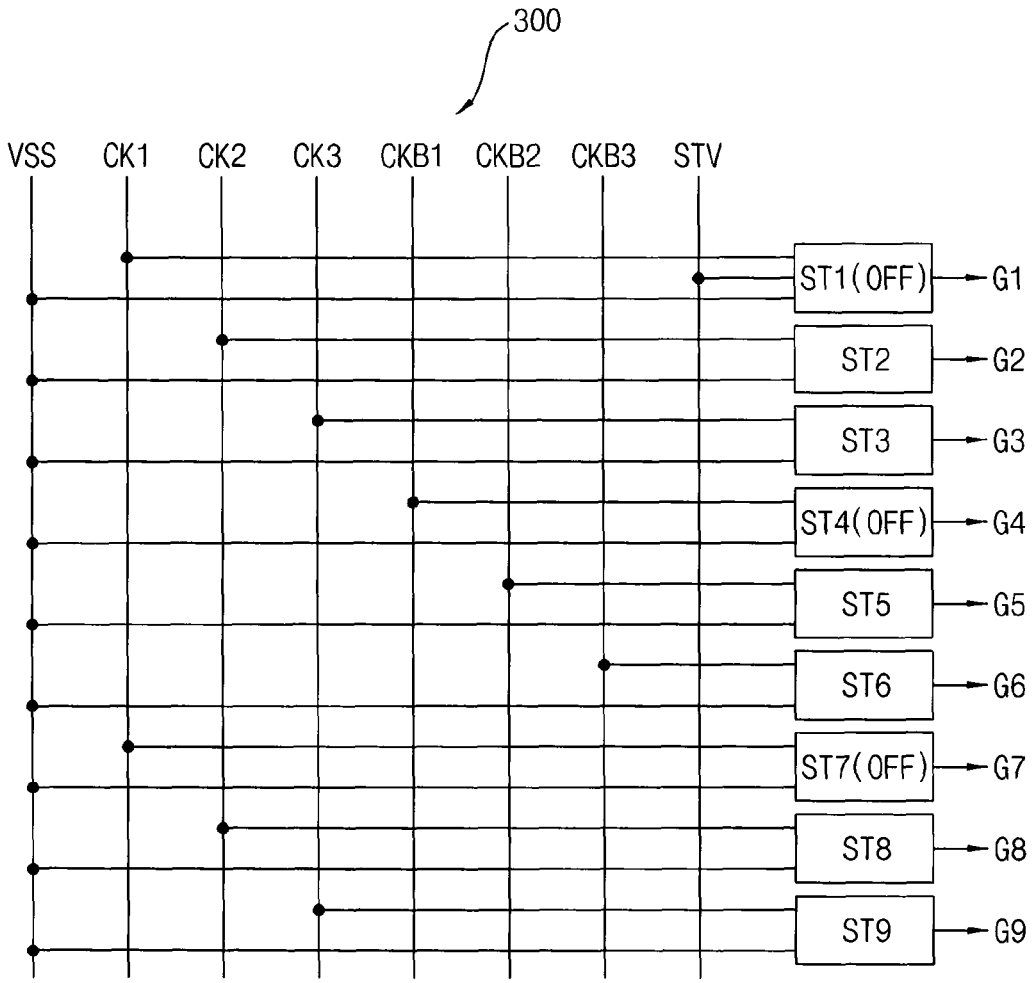
FIG. 5D is a conceptual diagram illustrating an operation of the gate driver of FIG. 4 during the (P+3)-th frame, according to an exemplary embodiment of the present inventive concept.

FIG. 4 is a conceptual diagram illustrating the gate driver 300 of FIG. 1. FIG. 5A is a conceptual diagram illustrating an operation of the gate driver 300 of FIG. 4 during the P-th frame. FIG. 5B is a conceptual diagram illustrating an operation of the gate driver 300 of FIG. 4 during the (P+1)-th frame. FIG. 5C is a conceptual diagram illustrating an operation of the gate driver 300 of FIG. 4 during the (P+2)-th frame. FIG. 5D is a conceptual diagram illustrating an operation of the gate driver 300 of FIG. 4 during the (P-+3)-th frame. FIG. 6 is a circuit diagram illustrating an N-th stage of the gate driver 300 of FIG. 4. Herein, N is a positive integer.

Referring to FIGS. 1 to 6, the gate driver 300 includes a plurality of stages ST1 to ST9. In FIGS. 4 to 5D, only a part of the stages of the gate driver 300 is shown for convenience of explanation. The number of the stages may correspond to the number of the gate lines of the display panel 100.

A first stage ST1 of the gate driver 300 outputs a first gate signal G1 to the first gate line GL1. A second stage ST2 of the gate driver 300 outputs a second gate signal G2 to the second gate line GL2. A third stage ST3 of the gate driver 300 outputs a third gate signal G3 to the third gate line GL3. A fourth stage ST4 of the gate driver 300 outputs a fourth gate signal G4 to the fourth gate line GL4. A fifth stage ST5 of the gate driver 300 outputs a fifth gate signal G5 to the fifth gate line GL5. A sixth stage ST6 of the gate driver 300 outputs a sixth gate signal G6 to the sixth gate line GL6.

All stages of the gate driver 300 receive a power voltage VSS. The power voltage VSS may include a first off voltage VSS1 and a second off voltage VSS2.

A (6M−5)-th stage (e.g. a first stage, a seventh stage, a thirteenth stage, . . . ) of the gate driver 300 outputs the gate signal based on a first clock signal CK1. A (6M−4)-th stage (e.g. a second stage, an eighth stage, a fourteenth stage, . . . ) of the gate driver 300 outputs the gate signal based on a second clock signal CK2. A (6M−3)-th stage (e.g. a third stage, a ninth stage, a fifteenth stage, . . . ) of the gate driver 300 outputs the gate signal based on a third clock signal CK3. A (6M−2)-th stage (e.g. a fourth stage, a tenth stage, a sixteenth stage, . . . ) of the gate driver 300 outputs the gate signal based on a first inverted clock signal CKB1. A (6M−1)-th stage (e.g. a fifth stage, an eleventh stage, a seventeenth stage, . . . ) of the gate driver 300 outputs the gate signal based on a second inverted clock signal CKB2. A 6M-th stage (e.g. a sixth stage, a twelfth stage, an eighteenth stage, . . . ) of the gate driver 300 outputs the gate signal based on a third inverted clock signal CKB3.

According to an exemplary embodiment of the present invention, the gate driver 300 operates the "three line skip" driving, the gate driver 300 may output the gate signals using three pairs CK1, CK2, CK3, CKB1, CKB2 and CKB3 of the clock signals.

In FIG. 5A, a first group of stages ST1, ST4 and ST7 connected to the first group of gate lines may be deactivated during the P-th frame. The first clock signal CK1 and the first inverted clock signal CKB1 that generate the gate signals applied to the first group of gate lines may be deactivated during the P-th frame.

In FIG. 5B, a second group of stages ST2, ST5 and ST8 connected to the second group of gate lines may be deactivated during the (P+1)-th frame. The second clock signal CK2 and the second inverted clock signal CKB2 that generate the gate signals applied to the second group of gate lines may be deactivated during the (P+1)-th frame.

In FIG. 5C, a third group of stages ST3, ST6 and ST9 connected to the third group of gate lines may be deactivated during the (P+2)-th frame. The third clock signal CK3 and the third inverted clock signal CKB3 that generate the gate signals applied to the third group of gate lines may be deactivated during the (P+2)-th frame.

In FIG. 5D, the first group of stages ST1, ST4 and ST7 connected to the first group of gate lines may be deactivated during the (P+3)-th frame, as is done during the P-th frame. The first clock signal CK1 and the first inverted clock signal CKB1 that generate the gate signals applied to the first group of gate lines may be deactivated during the (P+3)-th frame.

According to an exemplary embodiment of the present invention, the first group of stages ST1, ST4 and ST7, the second group of stages ST2, ST5 and ST8 and the third group of stages ST3, ST6 and ST9 are sequentially deactivated in a cycle of three frames.

Figure 6:
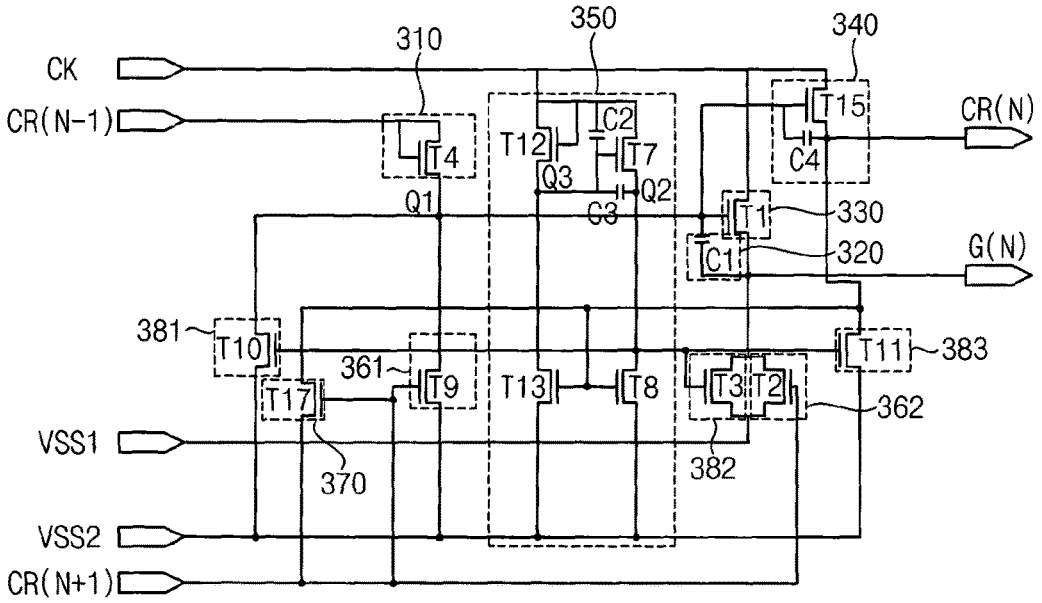
FIG. 6 is a circuit diagram illustrating an N-th stage of the gate driver of FIG. 4, according to an exemplary embodiment of the present inventive concept.

FIG. 6 is an exemplary circuit diagram of the N-th stage of the gate driver 300 according to an exemplary embodiment of the present invention. The N-th stage of the gate driver 300 receives a clock signal CK, the first off voltage VSS1 and the second off voltage VSS2. Herein the clock signal CK may be the first clock signal CK1, the second clock signal CK2, the third clock signal CK3, the first inverted clock signal CKB1, the second inverted clock signal CKB2, or the third inverted clock signal CKB3, according to a position of the N-th stage. The N-th stage of the gate driver 300 outputs the gate signal G(N).

The clock signal CK is applied to a clock terminal. The first off voltage VSS1 is applied to a first off terminal. The second off voltage VSS2 is applied to a second off terminal. The gate signal G(N) is outputted at a gate output terminal.

The clock signal CK is a square wave signal alternating between having a high level and a low level. The high level of the clock signal CK may have a gate on voltage. The low level of the clock signal CK may have the second off voltage VSS2. For example, a duty ratio of the clock signal CK may be equal to 50%. Alternatively, the duty ratio of the clock signal CK may be less than 50%. For example, the gate on voltage may be between about 15V and about 20V.

The first off voltage VSS1 may be a direct-current (DC) voltage. The second off voltage VSS2 may be a direct-current (DC) voltage. The second off voltage VSS2 may be less than the first off voltage VSS1. For example, the first off voltage VSS1 may be about −5V. For example, the second off voltage VSS2 may be about −10V.

The N-th stage outputs an N-th gate signal G(N) and an N-th carry signal CR(N) in response to an (N−1)-th carry signal CR(N−1) of an (N−1)-th stage which is a previous stage of the N-th stage. The N-th stage pulls down the gate signal G(N) to the first off voltage VSS1 in response to an (N+1)-th carry signal CR(N+1) of an (N+1)-th stage which is a next stage of the N-th stage. The vertical start signal STV may be applied to the first stage instead of the (N−1)-th stage.

In the above-explained method, the first to last stages sequentially output the corresponding gate signals.

The (N−1)-th carry signal CR(N−1) is applied to an (N−1)-th carry terminal. The (N+1)-th carry signal CR(N+1) is applied to an (N+1)-th carry terminal. The N-th carry signal CR(N) is applied to an N-th carry terminal.

The N-th stage includes a pull up control part 310, a charging part 320, a pull up part 330, a carry part 340, an inverting part 350, a first pull down part 361, a second pull down part 362, a carry stabilizing part 370, a first holding part 381, a second holding part 382 and a third holding part 383.

The pull up control part 310 includes a fourth transistor T4. The fourth transistor T4 includes a control electrode and an input electrode connected to the (N−1)-th carry terminal and an output electrode connected to a first node Q1. The first node Q1 is connected to a control electrode of the pull up part 330.

The charging part 320 includes a charging capacitor C1. The charging capacitor C1 includes a first electrode connected to the first node Q1 and a second electrode connected to the gate output terminal.

The pull up part 330 includes a first transistor T1. The first transistor T1 includes a control electrode connected to the first node Q1, an input electrode connected to the clock terminal and an output terminal connected to the gate output terminal.

The carry part 340 includes a fifteenth transistor T15 and a fourth capacitor C4. The fifteenth transistor T15 includes a control electrode connected to the first node Q1, an input electrode connected to the clock terminal and an output electrode connected to the N-th carry terminal. The fourth capacitor C4 includes a first electrode connected to the first node Q and a second electrode connected to the N-th carry terminal.

The inverting part 350 includes a twelfth transistor T12, a seventh transistor T7, a thirteenth transistor T13, an eighth transistor T8, a second capacitor and a third capacitor. The twelfth transistor T12 includes a control electrode and an input electrode which are connected to the clock terminal and an output electrode connected to a third node Q3. The seventh transistor T7 includes a control electrode connected to the third node Q3, an input electrode connected to the clock terminal and an output electrode connected to a second node Q2. The thirteenth transistor T13 includes a control electrode connected to the N-th carry terminal, an input electrode connected to the second off terminal and an output electrode connected to the third node Q3. The eighth transistor T8 includes a control electrode connected to the N-th carry terminal, an input electrode connected to the second off terminal and an output electrode connected to the second node Q2. The second capacitor C2 includes a first electrode connected to the clock terminal and a second terminal connected to the third node Q3. The third capacitor C3 includes a first electrode connected to the second node Q2 and a second electrode connected to the third node Q3.

Herein, the twelfth transistor T12 is a first inverting transistor. The seventh transistor T7 is a second inverting transistor. The thirteenth transistor T13 is a third inverting transistor. The eighth transistor T8 is a fourth inverting transistor.

The first pull down part 361 includes a ninth transistor T9. The ninth transistor T9 includes a control electrode connected to the (N+1)-th carry terminal, an input electrode connected to the second off terminal and an output electrode connected to the first node Q1.

Alternatively, the first pull down part 361 may include two or more switching elements connected to each other in series.

The second pull down part 362 includes a second transistor T2. The second transistor T2 includes a control electrode connected to the (N+1)-th carry terminal, an input electrode connected to the first off terminal and an output electrode connected to the gate output terminal.

The carry stabilizing part 370 includes a seventeenth transistor T17. The seventeenth transistor T17 includes a control electrode and an input electrode which are commonly connected to the (N+1)-th carry terminal and an output electrode connected to the N-th carry terminal.

The carry stabilizing part 370 stably removes noise caused by a leaked current transmitted through a fourth transistor T4 of an (N+1)-th stage.

The first holding part 381 includes a tenth transistor T10. The tenth transistor T10 includes a control electrode connected to the second node Q2, an input electrode connected to the second off terminal and an output electrode connected to the first node Q1.

The second holding part 382 includes a third transistor T3. The third transistor T3 includes a control electrode connected to the second node Q2, an input electrode connected to the first off terminal and an output electrode connected to the gate output terminal.

The third holding part 383 includes an eleventh transistor T11. The eleventh transistor T11 includes a control electrode connected to the second node Q2, an input electrode connected to the second off terminal and an output electrode connected to the N-th carry terminal.

In an exemplary embodiment of the present disclosure, the previous carry signal is not limited to the (N−1)-th carry signal. The previous carry signal may be any one of the carry signals of the previous stages. In addition, according to an exemplary embodiment of the present invention, the next carry signal is not limited to the (N+1)-th carry signal. The next carry signal may be any one of the carry signals of the next stages.

In an exemplary embodiment of the present invention, the first, second, third, fourth, seventh, eighth, ninth, tenth, eleventh, twelfth, thirteenth, fourteenth, fifteenth, and seventeenth transistors may be oxide semiconductor transistors. Alternatively, the first, second, third, fourth, seventh, eighth, ninth, tenth, eleventh, twelfth, thirteenth, fourteenth, fifteenth, and seventeenth transistors may be amorphous silicon semiconductor transistor.

The gate signal G(N) of the N-th stage is synchronized with the clock signal CK. The gate signal G(N) of the N-th stage has a high level corresponding to the N-th stage. The carry signal CR(N) of the N-th stage is synchronized with the clock signal CK. The carry signal CR(N) of the N-th stage has a high level corresponding to the N-th stage.

Figure 7:
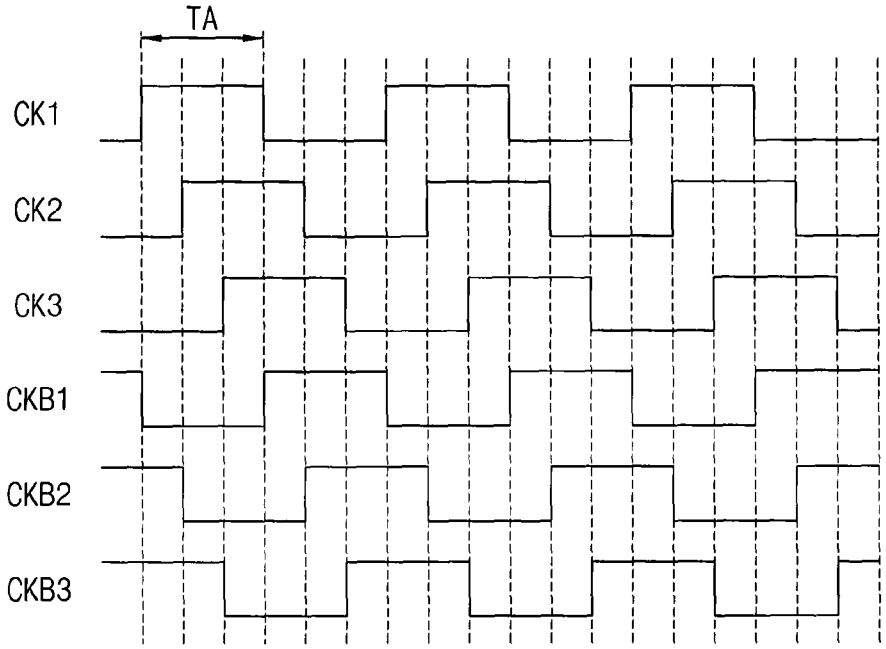
FIG. 7 is a timing diagram illustrating clock signals applied to the gate driver of FIG. 1 when the gate driver of FIG. 1 operates normal driving, according to an exemplary embodiment of the present inventive concept.

FIG. 7 is a timing diagram illustrating clock signals applied to the gate driver 300 of FIG. 1 when the gate driver 300 of FIG. 1 operates normal driving, in accordance with an exemplary embodiment of the present invention. FIG. 8A is a timing diagram illustrating clock signals applied to the gate driver 300 of FIG. 1 during the P-th frame when the gate driver 300 of FIG. 1 operates "three line skip" driving. FIG. 8B is a timing diagram illustrating clock signals applied to the gate driver 300 of FIG. 1 during the (P+1)-th frame when the gate driver 300 of FIG. 1 operates the "three line skip" driving. FIG. 8C is a timing diagram illustrating clock signals applied to the gate driver 300 of FIG. 1 during the (P+2)-th frame when the gate driver 300 of FIG. 1 operates the "three line skip" driving. FIG. 8D is a timing diagram illustrating clock signals applied to the gate driver 300 of FIG. 1 during the (P+3)-th frame when the gate driver 300 of FIG. 1 operates the "three line skip" driving. FIG. 9 is a block diagram illustrating the timing controller 200 of FIG. 1.

Referring to FIGS. 1 to 9, the timing controller 200 generates the gate clock signals CK1, CK2, CK3, CKB1, CKB2 and CKB3 and outputs the gate clock signals CK1, CK2, CK3, CKB1, CKB2 and CKB3 to the gate driver 300.

As shown in FIG. 7, when the gate driver 300 operates the normal driving in which the gate signals are outputted to each of the gate lines of the display panel 100, the first clock signal CK1 has a rising edge of a first time and has a first pulse width TA. The second clock signal CK2 has a rising edge of a second time, which is later than the first time by ⅓ of the first pulse width TA and has the first pulse width TA. The third clock signal CK3 has a rising edge of a third time which is later than the first time by ⅔ of the first pulse width TA and has the first pulse width TA. The first inverted clock signal CKB1 may be an inverted signal of the first clock signal CK1. The second inverted clock signal CKB2 may be an inverted signal of the second clock signal CK2. The third inverted clock signal CKB3 may be an inverted signal of the third clock signal CK3.

FIGS. 8A to 8C illustrate the clock signals according to an exemplary embodiment of the present invention, in the "three line skip" driving.

As shown in FIG. 8A, the first clock signal CK1 and the first inverted clock signal CKB1 are deactivated in a P-th frame so that the first group of stages ST1, ST4 and ST7 in FIG. 5A are deactivated. Since the first group of stages ST1, ST4 and ST7 are deactivated, gate signals G1, G4 and G7 applied to the first group of gate lines GL1, GL4 and GL7 are deactivated. Since the gate signals G1, G4 and G7 applied to the first group of gate lines GL1, GL4 and GL7 are deactivated, data voltages are not charged to subpixels in the subpixel rows connected to the first group of gate lines GL1, GL4 and GL7. When the data voltages are not charged to the subpixels in the subpixel rows connected to the first group of gate lines GL1, GL4 and GL7, the data voltages of the previous frame may be maintained at the subpixels.

In FIG. 8A, the first clock signal CK1 and the first inverted clock signal CKB1 are deactivated and the pulse widths TB of the second clock signal CK2, the second inverted clock signal CKB2, the third clock signal CK3 and the third inverted clock signal CKB3 may be increased. The number of the gate lines to be scanned is decreased by ⅔ so that the pulse widths TB of the second clock signal CK2, the second inverted clock signal CKB2, the third clock signal CK3 and the third inverted clock signal CKB3 may be 3/2 times the pulse width TA of the clock signal in the normal driving in FIG. 7.

For example, the second clock signal CK2 has a rising edge of a first time and has a second pulse width TB, the third clock signal CK3 has a rising edge of a second time which is later than the first time by ½ of the second pulse width TB and has the second pulse width TB. The second inverted clock signal CKB2 may be an inverted signal of the second clock signal CK2. The third inverted clock signal CKB3 may be an inverted signal of the third clock signal CK3.

The gate signal is generated based on the pulse of the clock signal. Accordingly, when the pulse width of the clock signal is increased, the pulse width of the gate signal is increased in the "three line skip" driving. According to the increase of the pulse width of the gate signal in the "three line skip" driving, timing of applying the data voltage may be adjusted. For example, the data driver 500 night not output the data voltage of the subpixels of the subpixel rows corresponding to the first group of gate lines. The data driver 500 may output only the data voltage of the subpixels of the subpixel rows corresponding to the second group of gate lines and the data voltage of the subpixels of the subpixel rows corresponding to the third group of gate lines.

As shown in FIG. 8B, the second clock signal CK2 and the second inverted clock signal CKB2 are deactivated in a (P+1)-th frame so that the second group of stages ST2, ST5 and ST8 in FIG. 5B are deactivated. Since the second group of stages ST2, ST5 and ST8 are deactivated, gate signals G2, G5 and G8 applied to the second group of gate lines GL2, GL5 and GL8 are deactivated. Since the gate signals G2, G5 and G8 applied to the second group of gate lines GL2, GL5 and GL8 are deactivated, data voltages are not charged to subpixels in the subpixel rows connected to the second group of gate lines GL2, GL5 and GL8. When the data voltages are not charged to the subpixels in the subpixel rows connected to the second group of gate lines GL2, GL5 and GL8, the data voltages of the previous frame may be maintained at the subpixels.

As shown in FIG. 8C, the third clock signal CK3 and the third inverted clock signal CKB3 are deactivated in a (P+2)-th frame so that the third group of stages ST3, ST6 and ST9 in FIG. 5C are deactivated. Since the third group of stages ST3, ST6 and ST9 are deactivated, gate signals G3, G6 and G9 applied to the third group of gate lines GL3, GL6 and GL9 are deactivated. Since the gate signals G3, G6 and G9 applied to the third group of gate lines GL3, GL6 and GL9 are deactivated, data voltages are not charged to subpixels in the subpixel rows connected to the third group of gate lines GL3, GL6 and GL9. When the data voltages are not charged to the subpixels in the subpixel rows connected to the third group of gate lines GL3, GL6 and GL9, the data voltages of the previous frame may be maintained at the subpixels.

As shown in FIG. 8D, the display panel is driven in a (P+3)-th frame same as in the P-th frame. According to an exemplary embodiment of the present invention, the driving method is repeated in a cycle of three frames.

The timing controller 200 includes an image compensating part 220, a mode determining part 240 and a signal generating part 280.

The image compensating part 220 receives the input image data IMG. The image compensating part 220 may receive the input image data IMG[P] of a present frame and the input image data IMG[P−1] of a previous frame. The image compensating part 220 compensates grayscale values of the input image data IMG. The image compensating part 220 may include an adaptive color correction part and a dynamic capacitance compensation part.

The adaptive color correction part receives the grayscale values of the input image data IMG[P] and operates an adaptive color correction to the grayscale values of the input image data IMG[P]. The adaptive color correction part may compensate the grayscale values using a gamma curve.

The dynamic capacitance compensation part operates a dynamic capacitance compensation which compensates the grayscale values of the present frame data IMG[P] using the previous frame data IMG[P−1] and the present frame data IMG[P].

The image compensating part 220 compensates the grayscale values of the input image data IMG[P] and generates the data signal DATA[P] by rearranging the input image data IMG[P] to correspond to a data type of the data driver 500. The data signal DATA may be a digital signal. The image compensating part 220 outputs the data signal DATA to the data driver 500.

The mode determining part 240 receives the input image data IMG. The mode determining part 240 may receive the input image data IMG[P] of the present frame and the input image data IMG[P−1] of the previous frame.

The mode determining part 240 may determine a driving mode MODE of the gate driver 300 based on the input image data IMG. The driving mode MODE may include a first mode (a normal driving mode) and a second mode (a "three line skip" mode).

When the driving mode MODE is the first mode, the gate signals applied to each of the gate lines of the display panel 100 may be activated in the P-th frame, the (P+1)-th frame and the (P+2)-th frame.

When the driving mode MODE is the second mode, the gate signals applied to the first group of gate lines of the display panel 100 may be deactivated in the P-th frame, the gate signals applied to the second group of gate lines of the display panel 100 may be deactivated in the (P+1)-th frame and the gate signals applied to the third group of gate lines of the display panel 100 may be deactivated in the (P+2)-th frame.

The mode determining part 240 may compare the input image data IMG[P−1] of the previous frame and the input image data IMG[P] of the present frame. When the difference between the input image data IMG[P−1] of the previous frame and the input image data IMG[P] of the present frame is relatively great, the mode determining part 240 may determine the driving mode MODE is the first mode. In contrast, when the difference between the input image data IMG[P−1] of the previous frame and the input image data IMG[P] of the present frame is relatively little, the mode determining part 240 may determine that the driving mode MODE is the second mode. When the difference between the input image data IMG[P−1] of the previous frame and the input image data IMG[P] of the present frame is relatively great and the display panel 100 is driven in the "three line skip" driving, a display defect of the display panel 100 may be generated. Thus, it may be only when the difference between the input image data IMG[P−1] of the previous frame and the input image data IMG[P] of the present frame is relatively little, that the display panel 100 may be driven in the "three line skip" driving.

Alternatively, the mode determining part 240 may determine the driving mode MODE based on a moving velocity of a pattern in the previous frame and the present frame.

When the moving velocity of the pattern in the previous frame and the present frame is relatively great, the mode determining part 240 may determine the driving mode MODE is the first mode. In contrast, when the moving velocity of the pattern in the previous frame and the present frame is relatively little, the mode determining part 240 may determine the driving mode MODE is the second mode.

When the moving velocity of the pattern in the previous frame and the present frame is relatively great and the display panel 100 is driven in the "three line skip" driving, a portion of the pattern corresponding to the skipped gate line is not displaced so that a display defect of the display panel 100 due to the not moving portion may be generated. Thus, it may be only when the moving velocity of the pattern in the previous frame and the present frame is relatively little, that the display panel 100 may be driven in the "three line skip" driving.

The signal generating part 260 receives the input control signal CONT and the driving mode MODE. The signal generating part 260 generates the first control signal CONT1 for controlling the driving timing of the gate driver 300 and the second control signal CONT2 for controlling the driving timing of the data driver 500 based, on the input control signal CONT and the driving mode MODE.

When the driving mode MODE is the first mode, the signal generating part 260 may generate the first clock signal CK1, the second clock signal CK2, the third clock signal CK3, the first inverted clock signal CKB1, the second inverted clock signal CKB2, and the third inverted clock signal CKB3, as shown in FIG. 7.

When the driving mode MODE is the second mode, the signal generating part 260 may generate the first clock signal CK1, the second clock signal CK2, the third clock signal CK3, the first inverted clock signal CKB1, the second inverted clock signal CKB2, and the third inverted clock signal CKB3, as shown in FIGS. 8A, 8B and 8C.

The signal generating part 260 generates the third control signal CONT3 for controlling the driving timing of the gamma reference voltage generator 400 based on the input control signal CONT and the driving mode MODE.

The signal generating part 260 outputs the first control signal CONT1 to the gate driver 300. The signal generating part 260 outputs the second control signal CONT2 to the data driver 500. The signal generating part 260 outputs the third control signal CONT3 to the gamma reference voltage generator 400.

According to the present exemplary embodiment of the present invention, the gate signals applied to some of the gate lines are deactivated according to the frames, and a data charging time in a horizontal period may be reduced. Thus, the charging rate of the data voltage of the subpixel may be increased so that the display quality of the display panel 100 may be enhanced.

Figure 10A:
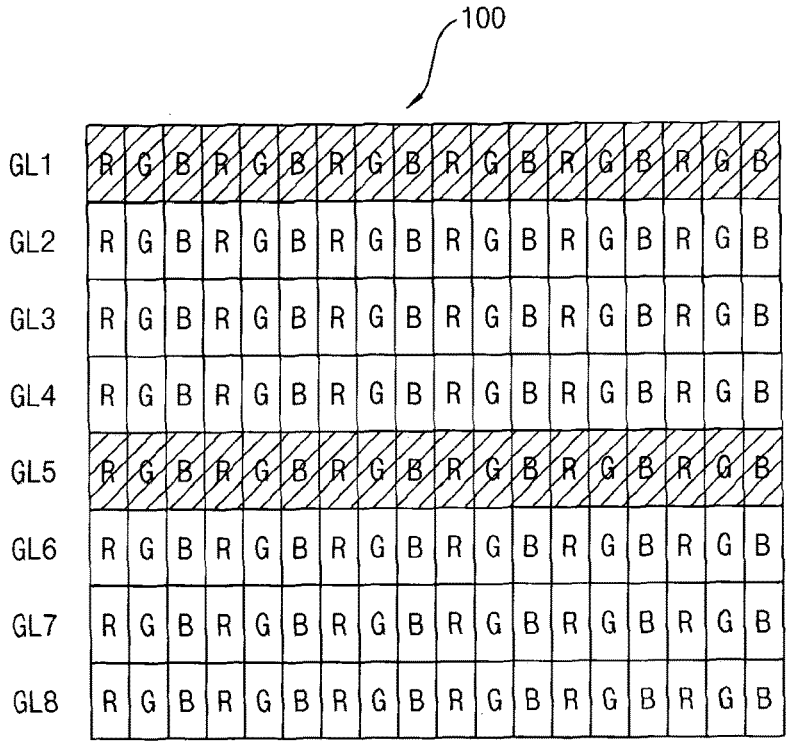
FIG. 10A is a conceptual diagram illustrating a method of driving a display panel according to an exemplary embodiment during a P-th frame, according to an exemplary embodiment of the present inventive concept.
Figure 10B:
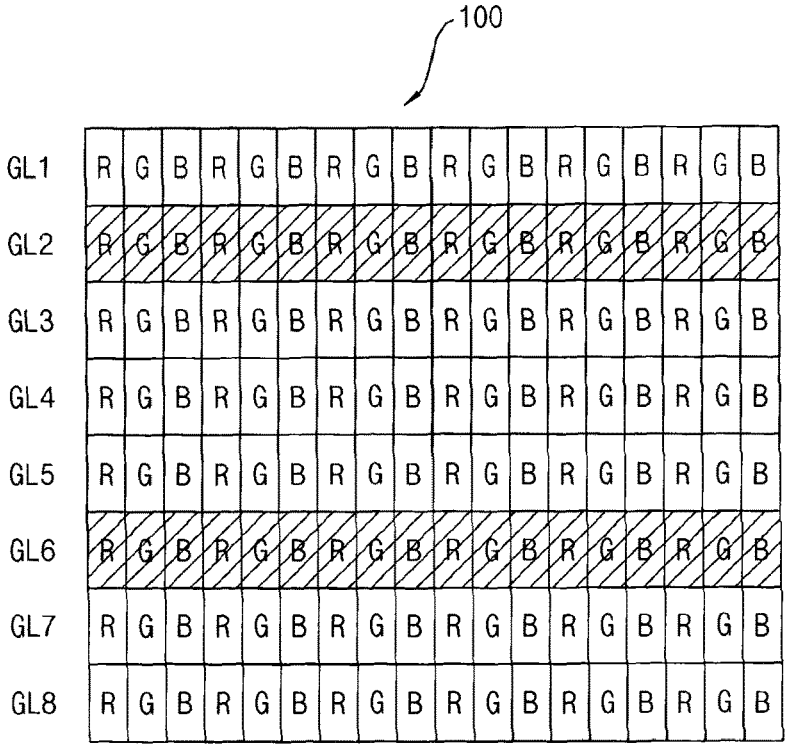
FIG. 10B is a conceptual diagram illustrating a method of driving the display panel of FIG. 10A during a (P+1)-th frame, according to an exemplary embodiment of the present inventive concept.
Figure 10C:
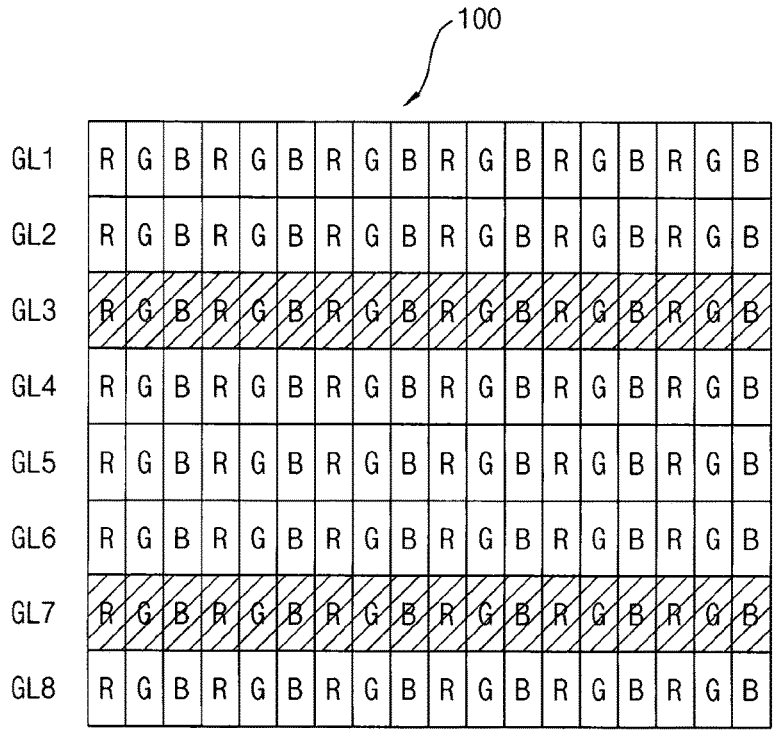
FIG. 10C is a conceptual diagram illustrating a method of driving the display panel of FIG. 10A during a (P+2)-th frame, according to an exemplary embodiment of the present inventive concept.
Figure 10D:
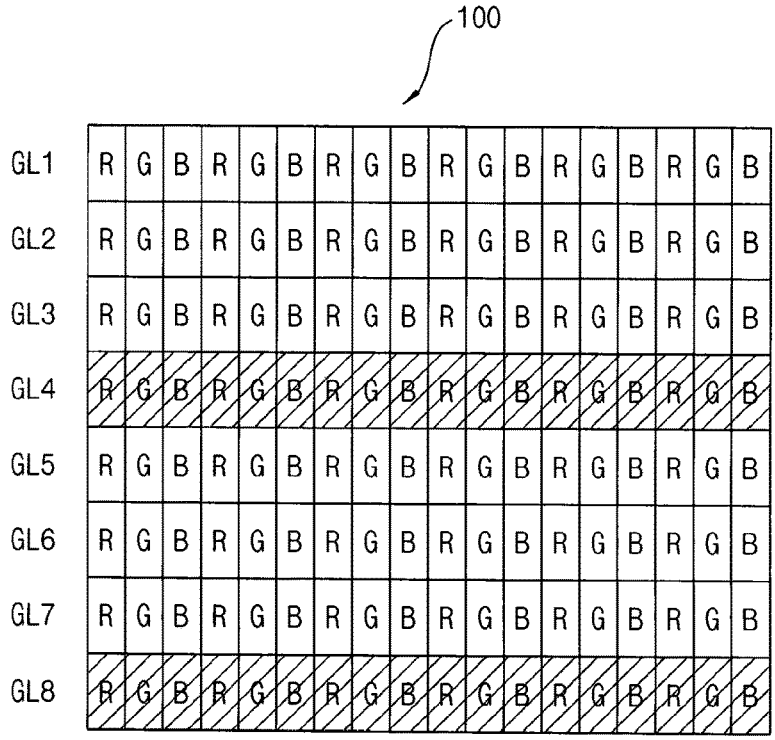
FIG. 10D is a conceptual diagram illustrating a method of driving the display panel of FIG. 10A during a (P+3)-th frame, according to an exemplary embodiment of the present inventive concept.
Figure 10E:
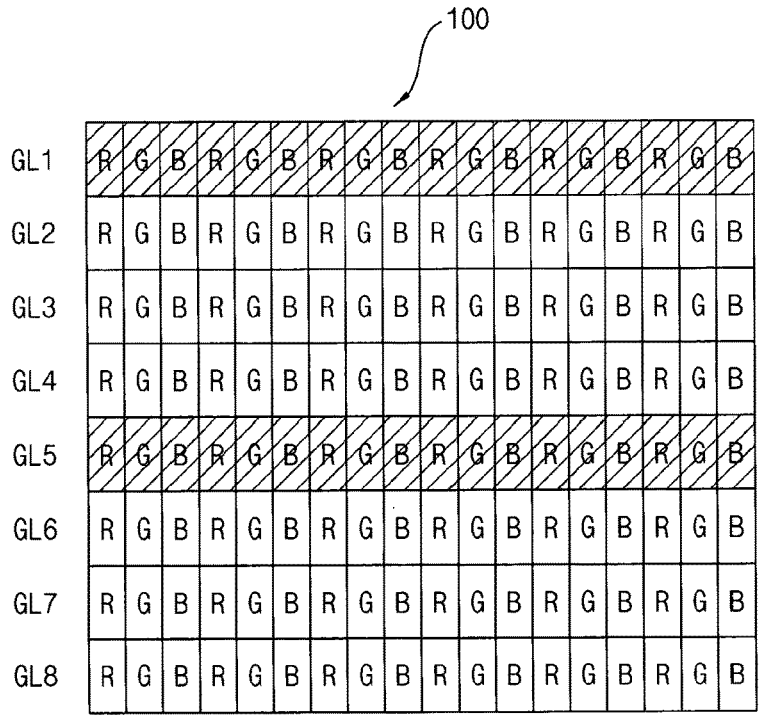
FIG. 10E is a conceptual diagram illustrating a method of driving the display panel of FIG. 10A during a (P+4)-th frame, according to an exemplary embodiment of the present inventive concept.

FIG. 10A is a conceptual diagram illustrating a method of driving a display panel according to an exemplary embodiment of the present invention, during a P-th frame. FIG. 10B is a conceptual diagram illustrating a method of driving the display panel of FIG. 10A during a (P+1)-th frame. FIG. 10C is a conceptual diagram illustrating a method of driving the display panel of FIG. 1 OA during a (P+2)-th frame. FIG. 10D is a conceptual diagram illustrating a method of driving the display panel of FIG. 10 OA during a (P+3)-th frame. FIG. 10E is a conceptual diagram illustrating a method of driving the display panel of FIG. 10A during a (P+4)-th frame.

The method of driving the display panel and the display apparatus according to an exemplary embodiment of the present invention may be substantially the same as the method of driving the display panel and the display apparatus discussed above with respect to FIGS. 1 to 9 except that the gate driver operates a "four line skip" driving in a cycle of four frames. Thus, the same reference numerals may be used to refer to the same or like parts as those described in the previous exemplary embodiment of FIGS. 1 to 9 and it may be assumed that any omitted description is similar to, or identical to, corresponding features that have been described above.

Referring to FIGS. 1 to 10E, the display panel 100 includes a plurality of subpixels disposed in a matrix form. The display panel 100 may include a first subpixel having a first color, a second subpixel having a second color, and a third subpixel having a third color. For example, the first color may be red R. For example, the second color may be green G. For example, the third color may be blue B.

According to an exemplary embodiment of the present invention, the first subpixel having the first color R, the second subpixel having the second color G, and the third subpixel having the third color B, are alternately disposed along a row direction and the subpixels having the same color are disposed along a column direction in the display panel 100.

According to an exemplary embodiment of the present invention, the display panel 100 is driven in "four line skip" driving. During the P-th frame, gate signals applied to a first group of gate lines are deactivated. During the (P+1)-th frame, gate signals applied to a second group of gate lines are deactivated. During the (P+2)-th frame, gate signals applied to a third group of gate lines are deactivated. During the (P+3)-th frame, gate signals applied to a fourth group of gate lines are deactivated. During the (P+4)-th frame, gate signals applied to the first group of gate lines are deactivated the same as during the P-th frame.

For example, the first group of gate lines may be (4M−3)-th gate lines. Herein, M is a positive integer. The first group of gate lines may include the first gate line GL1 and the fifth gate line GL5.

For example, the second group of gate lines may be (4M−2)-th gate lines. The second group of gate lines may include the second gate line GL2 and the sixth gate line GL6.

For example, the third group of gate lines may be (4M−1)-th gate lines. The third group of gate lines may include the third gate line GL3 and the seventh gate line GL7.

For example, the fourth group of gate lines may be 4M-th gate lines. The fourth group of gate lines may include the fourth gate line GL4 and the eighth gate line GL8.

The number of the first group of gate lines may be less than a half of the number of all gate lines of the display panel 100. The number of the second group of gate lines may be less than a half of the number of all gate lines of the display panel 100. The number of the third group of gate lines may be less than a half of the number of all gate lines of the display panel 100. The number of the fourth group of gate lines may be less than a half of the number of all gate lines of the display panel 100. For example, the number of the first group of gate lines may be substantially the same as the number of the second group of gate lines. For example, the number of the first group of gate lines may be substantially the same as the number of the third group of gate lines. For example, the number of the first group of gate lines may be substantially the same as the number of the fourth group of gate lines.

According to an exemplary embodiment of the present invention, the number of the first group of gate lines may be ¼ of all gate lines of the display panel 100.

According to an exemplary embodiment of the present invention, the gate driver 300 operates the "four line skip" driving using the clock signal. As explained referring to FIGS. 5A to 5D and 8A to 8D, when the gate signals applied to the first group of gate lines are deactivated, the first group of the stages outputting the gate signals applied to the first group of gate lines are deactivated and the clock signal for generating the gate signals applied to the first group of gate lines may be deactivated.

Similar to FIG. 8A, when the first clock signal CK1 and the first inverted clock signal CKB1 are deactivated, the pulse widths of the second clock signal CK2 and the second inverted clock signal CKB2, the third clock signal CK3, the third inverted clock signal CKB3, a fourth clock signal CK4, and the fourth inverted clock signal CKB4 may be increased compared to the pulse width TA in the normal driving in FIG. 7. The number of the gate lines to be scanned is decreased by ¾ so that the pulse widths of the second clock signal CK2, the second inverted clock signal CKB2, the third clock signal CK3, the third inverted clock signal CKB3, the fourth clock signal CK4, and the fourth inverted clock signal CKB4 may be 4/3 times the pulse width TA of the clock signal in the normal driving in FIG. 7.

According to an exemplary embodiment of the present invention, the gate signals applied to some of the gate lines are deactivated according to the frames, and a data charging time in a horizontal period may be reduced. Thus, the charging rate of the data voltage of the subpixel may be increased so that the display quality of the display panel 100 may be enhanced.

Figure 11A:
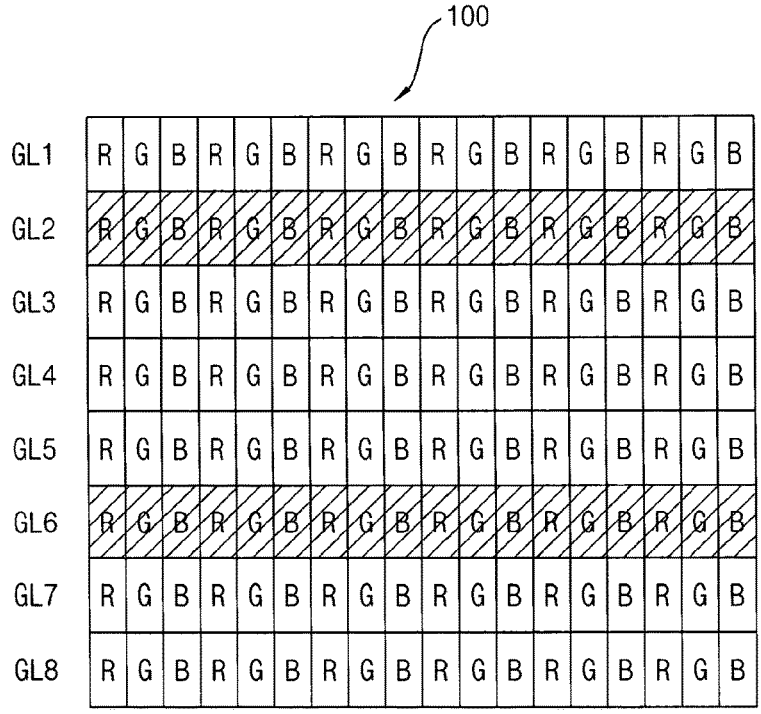
FIG. 11A is a conceptual diagram illustrating a method of driving a display panel according to an exemplary embodiment during a P-th frame, according to an exemplary embodiment of the present inventive concept.
Figure 11B:
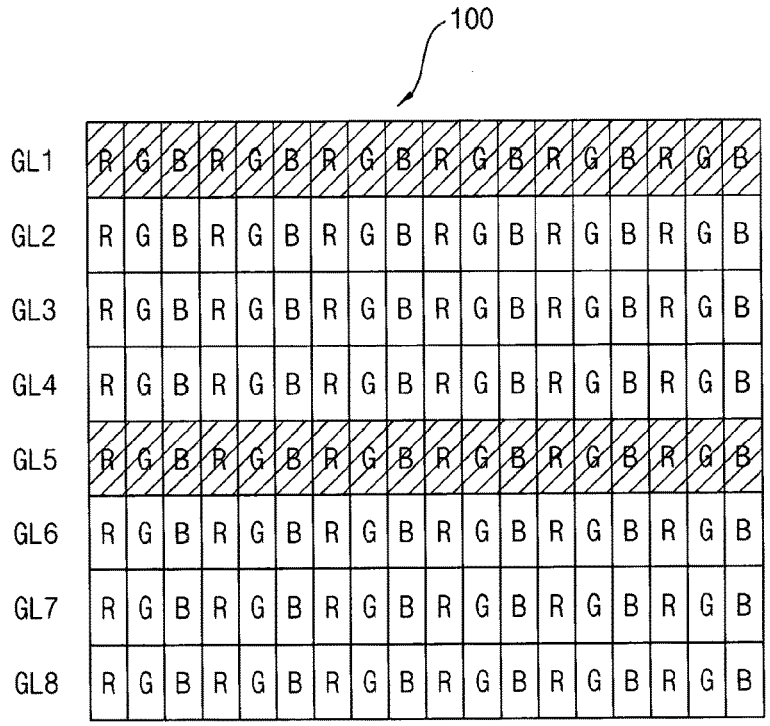
FIG. 11B is a conceptual diagram illustrating a method of driving the display panel of FIG. 11A during a (P+1)-th frame, according to an exemplary embodiment of the present inventive concept.
Figure 11C:
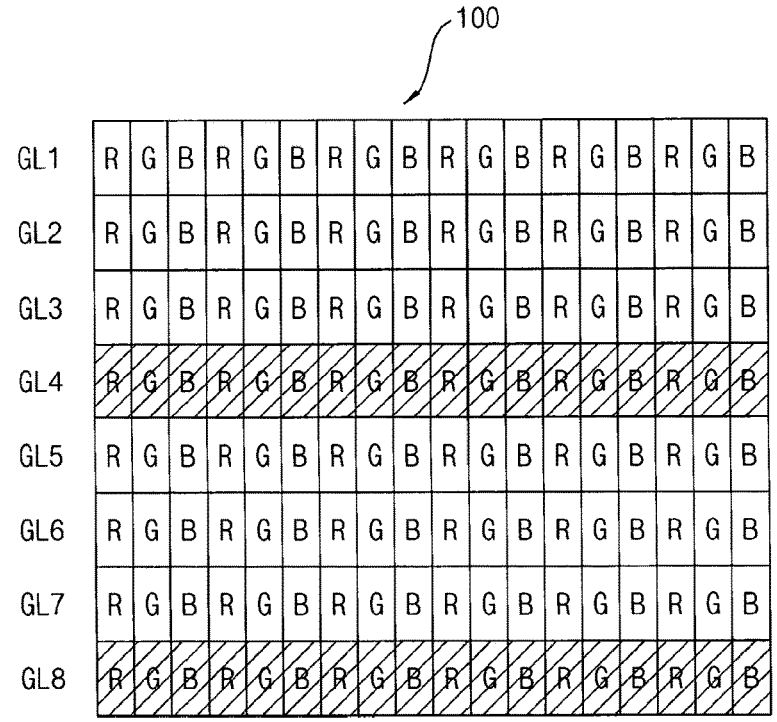
FIG. 11C is a conceptual diagram illustrating a method of driving the display panel of FIG. 11A during a (P+2)-th frame, according to an exemplary embodiment of the present inventive concept.
Figure 11D:
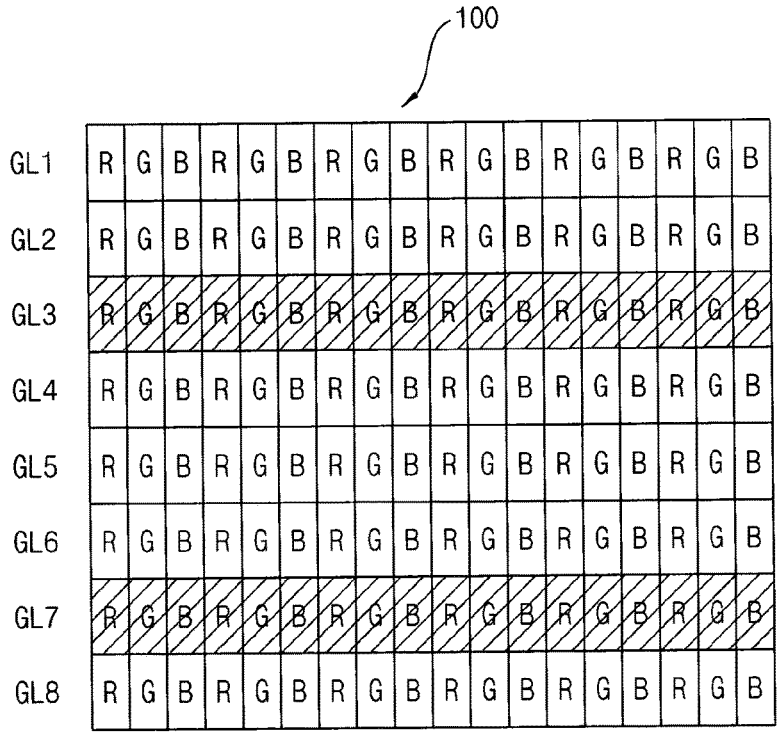
FIG. 11D is a conceptual diagram illustrating a method of driving the display panel of FIG. 11A during a (P+3)-th frame, according to an exemplary embodiment of the present inventive concept.
Figure 11E:
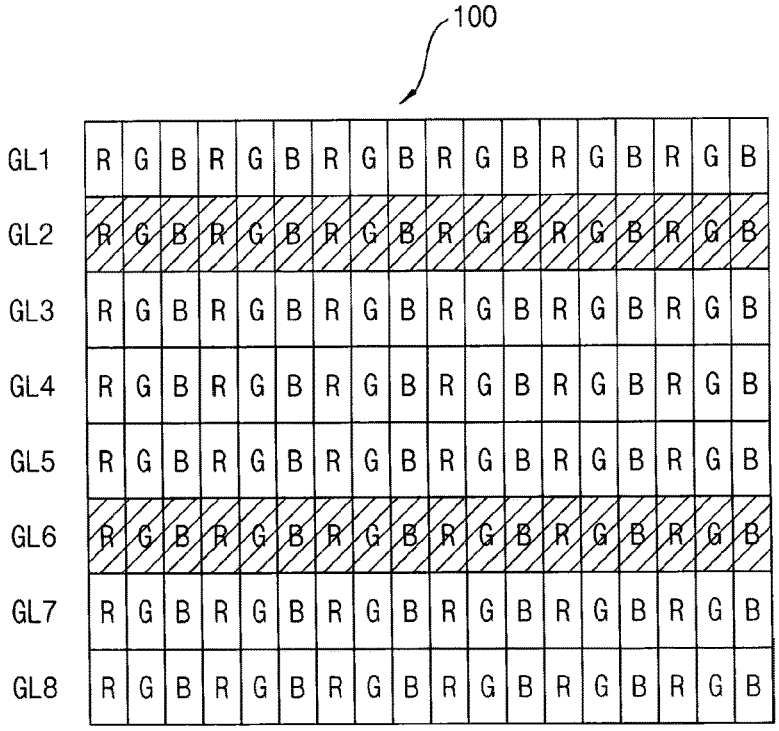
FIG. 11E is a conceptual diagram illustrating a method of driving the display panel of FIG. 11A during a (P+4)-th frame, according to an exemplary embodiment of the present inventive concept.

FIG. 11A is a conceptual diagram illustrating a method of driving a display panel according to an exemplary embodiment of the present invention, during a P-th frame. FIG. 11B is a conceptual diagram illustrating a method of driving the display panel of FIG. 11A during a (P+1)-th frame. FIG. 11C is a conceptual diagram illustrating a method of driving the display panel of FIG. 11A during a (P+2)-th frame. FIG. 11D is a conceptual diagram illustrating a method of driving the display panel of FIG. 11A during a (P+3)-th frame. FIG. 11E is a conceptual diagram illustrating a method of driving the display panel of FIG. 11A during a (P+4)-th frame.

A method of driving the display panel and the display apparatus according to an exemplary embodiment of the present invention may be substantially the same as the method of driving the display panel and the display apparatus described above with respect to FIGS. 10A to 10E except that the gate driver operates a random "four line skip" driving in a cycle of four frames instead of the sequential "four line skip" driving in a cycle of four frames. Thus, the same reference numerals may be used to refer to the same or like parts as those previously described with reference to FIGS. 10A to 10E and any elements not described may be understood to be similar to or identical to corresponding elements that have previously been described.

Referring to FIGS. 10A to 11E, the display panel 100 includes a plurality of subpixels disposed in a matrix form. The display panel 100 may include a first subpixel having a first color, a second subpixel having a second color, and a third subpixel having a third color. For example, the first color may be red R. For example, the second color may be green G. For example, the third color may be blue B.

According to an exemplary embodiment of the present invention, the first subpixel having the first color R, the second subpixel having the second color G, and the third subpixel having the third color B are alternately disposed along a row direction and the subpixels having the same color are disposed along a column direction in the display panel 100.

The display panel 100 may be driven according to "four line skip" driving. During the P-th frame, gate signals applied to a second group of gate lines are deactivated. During the (P+1)-th frame, gate signals applied to a first group of gate lines are deactivated. During the (P+2)-th frame, gate signals applied to a fourth group of gate lines are deactivated. During the (P+3)-th frame, gate signals applied to a third group of gate lines are deactivated. During the (P+4)-th frame, gate signals applied to the second group of gate lines are deactivated the same as during the P-th frame.

For example, the first group of gate lines may be (4M−3)-th gate lines. Herein, M is a positive integer. The first group of gate lines may include the first gate line GL1 and the fifth gate line GL5.

For example, the second group of gate lines may be (4M−2)-th gate lines. The second group of gate lines may include the second gate line GL2 and the sixth gate line GL6.

For example, the third group of gate lines may be (4M−1)-th gate lines. The third group of gate lines may include the third gate line GL3 and the seventh gate line GL7.

For example, the fourth group of gate lines may be 4M-th gate lines. The fourth group of gate lines may include the fourth gate line GL4 and the eighth gate line GL8.

According to an exemplary embodiment of the present invention, the first to fourth groups of the gate lines are not sequentially deactivated but randomly deactivated. Thus, a possible display defect due to the sequential inactivation of the first to fourth groups of the gate lines may be prevented.

According to an exemplary embodiment of the present invention, the gate signals applied to some of the gate lines are deactivated according to the frames, a data charging time in a horizontal period may be reduced. Thus, the charging rate of the data voltage of the subpixel may be increased so that the display quality of the display panel 100 may be enhanced.

Figure 12A:
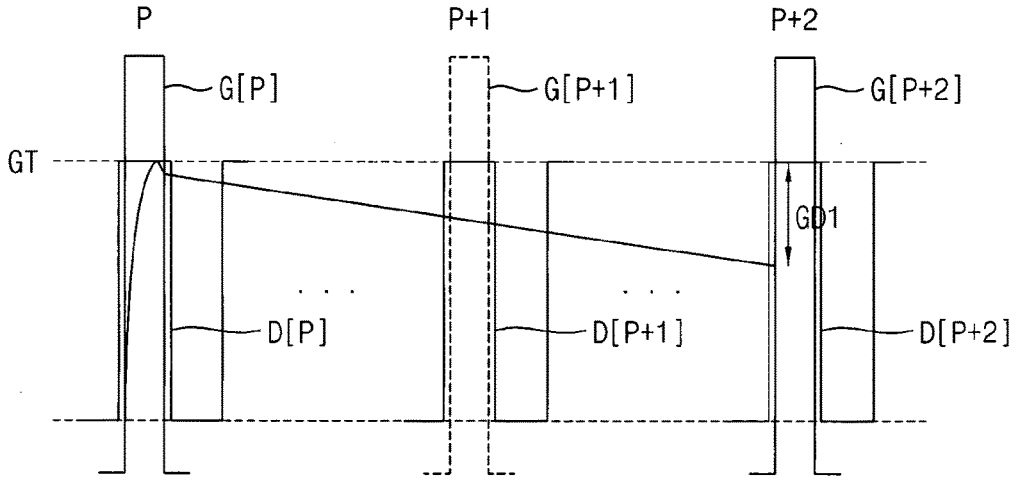
FIG. 12A is a timing diagram illustrating a gate signal and a data voltage applied to a subpixel of a display panel, according to an exemplary embodiment of the present inventive concept, when overdriving is not applied to the display panel.
Figure 12B:
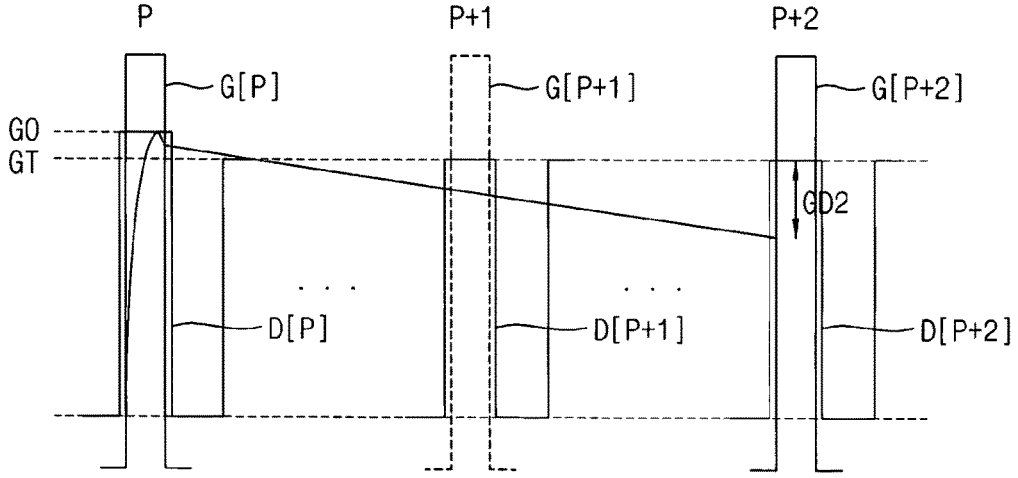
FIG. 12B is a timing diagram illustrating the gate signal and the data voltage applied to the subpixel of the display panel, according to an exemplary embodiment of the present inventive concept, when overdriving is applied to the display panel.

FIG. 12A is a timing diagram illustrating the gate signal and the data voltage applied to the subpixel of the display panel 100, according to an exemplary embodiment of the present invention, when overdriving is not applied to the display panel 100. FIG. 12B is a timing diagram illustrating the gate signal and the data voltage applied to the subpixel of the display 100 panel, according to an exemplary embodiment of the present invention, when overdriving is applied to the display panel 100.

The method of driving the display panel and the display apparatus may be substantially the same as the method of driving the display panel and the display apparatus previously described with respect to FIGS. 1 to 9 except that the data voltage is overdriven in a previous frame of a skipped frame when the gate signal is skipped. Thus, the same reference numerals may be used to refer to the same or like parts as those previously described with reference to FIGS. 1 to 9 and any omitted explanation may be assumed to be the same as previously described.

In FIG. 12A, the gate signal corresponding to a first subpixel is skipped in a (P+1)-th frame. In FIG. 12A, a data voltage D[N] corresponding to a target grayscale value GT is applied to the first subpixel in response to a gate signal G[P] in a P-th frame. The data voltage D[N] charged at the first subpixel is gradually discharged as time passes. In FIG. 12A, the gate signal G[P+1] corresponding to the first subpixel in the (P+1)-th frame is skipped so that the data voltage D[N+I] is not applied to the first subpixel in the (P+1)-th frame. The data voltage of the first subpixel is further discharged until right before a (P+2)-th frame so that the discharged voltage of the data voltage of the first subpixel with respect to the target grayscale value GT is GD from the P-th frame to right before the (P+2)-th frame. Thus, the first subpixel represents a grayscale value less than a desired grayscale value by GD1 at a time right before the (P+2)-th frame.

In FIG. 12B, the gate signal corresponding to a first subpixel is skipped in the (P+1)-th frame. In FIG. 12B, a data voltage D[N] corresponding to an overdriving grayscale value GO greater than the target grayscale value GT is applied to the first subpixel in response to a gate signal G[P] in the P-th frame. The data voltage D[N] charged at the first subpixel is gradually discharged as time passes. In FIG. 12B, the gate signal G[P+1] corresponding to the first subpixel in the (P+1)-th frame is skipped so that the data voltage D[N+1] is not applied to the first subpixel in the (P+1)-th frame. The data voltage of the first subpixel is further discharged until right before the (P+2)-th frame so that the discharged voltage of the data voltage of the first subpixel with respect to the target grayscale value GT is GD2 from the P-th frame to right before the (P+2)-th frame. Thus, the first subpixel represents a grayscale value less than a desired grayscale value by GD2 at a time right before the (P+2)-th frame.

The difference GD2 between the data voltage and the target grayscale voltage in FIG. 12B is less than the difference GD1 between the data voltage and the target grayscale voltage in FIG. 12A. When the gate lines are driven in a "gate line skip" driving, in the present frame, the overdriving grayscale value greater than the target grayscale value may be applied to the subpixel connected to the gate line which is skipped in the previous frame. Thus, the deterioration of the display quality due to the discharge of the data voltage may be prevented.

For example, when the gate signals applied to the first group of gate lines are deactivated in the P-th frame, the data voltage having the overdriving grayscale value greater than the target grayscale value may be applied to the subpixels of the subpixel rows connected to the first group of gate lines in the (P−1)-th frame.

For example, when the gate signals applied to the second group of gate lines are deactivated in the (P+1)-th frame, the data voltage having the overdriving grayscale value greater than the target grayscale value may be applied to the subpixels of the subpixel rows connected to the second group of gate lines in the P-th frame.

For example, when the gate signals applied to the third group of gate lines are deactivated in the (P+2)-th frame, the data voltage having the overdriving grayscale value greater than the target grayscale value may be applied to the subpixels of the subpixel rows connected to the third group of gate lines in the (P+1)-th frame.

The method of applying the data voltage having the overdriving grayscale value in the previous frame of the skipped frame in the "gate line skip" driving may be applied to the exemplary embodiment of the "three line sequential skip" driving explained above with reference to FIGS. 3A to 3D, the exemplary embodiment of the four line sequential skip driving explained above with reference to FIGS. 10A to 10E, and the exemplary embodiment of the four line random skip driving explained above with reference to FIGS. 11A to 11E.

According to exemplary embodiments of the present invention, the gate signals applied to some of the gate lines are deactivated by frames, a data charging time in a horizontal period may be reduced. Thus, the charging rate of the data voltage of the subpixel may be increased so that the display quality of the display panel 100 may be enhanced.

In addition, in the present frame, the overdriving grayscale value GO, which is greater than the target grayscale value GT, may be applied to the subpixel connected to the gate line which is skipped in the previous frame. Thus, the deterioration of the display quality due to the discharge of the data voltage may be prevented.

Figure 14B:
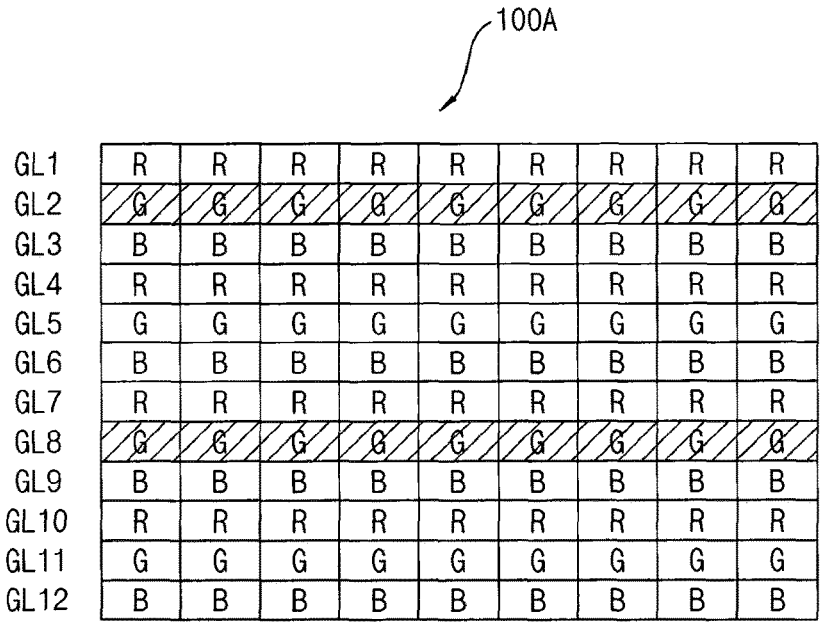
FIG. 14B is a conceptual diagram illustrating a method of driving the display panel of FIG. 13 during a (P+1)-th frame, according to an exemplary embodiment of the present inventive concept.
Figure 14C:
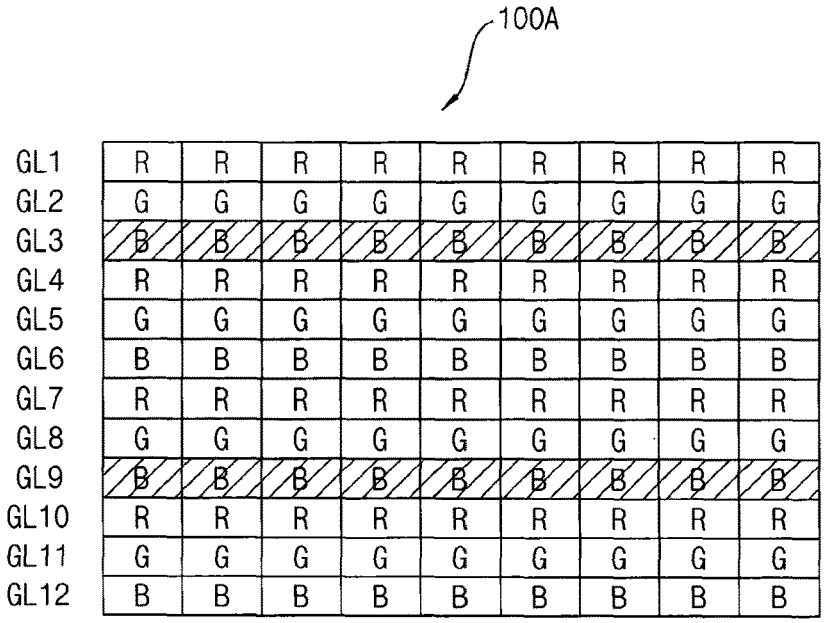
FIG. 14C is a conceptual diagram illustrating a method of driving the display panel of FIG. 13 during a (P+2)-th frame, according to an exemplary embodiment of the present inventive concept.

FIG. 13 is a conceptual diagram illustrating a display panel 100A according to an exemplary embodiment of the present invention. FIG. 14A is a conceptual diagram illustrating a method of driving the display panel 100A of FIG. 13 during a P-th frame. FIG. 14B is a conceptual diagram illustrating a method of driving the display panel 100A of FIG. 13 during a (P+1)-th frame. FIG. 14C is a conceptual diagram illustrating a method of driving the display panel 100A of FIG. 13 during a (P+2)-th frame. FIG. 14D is a conceptual diagram illustrating a method of driving the display panel 100A of FIG. 13 during a (P+3)-th frame. FIG. 14E is a conceptual diagram illustrating a method of driving the display panel 100A of FIG. 13 during a (P+4)-th frame. FIG. 14F is a conceptual diagram illustrating a method of driving the display panel 100A of FIG. 13 during a (P+5)-th frame. FIG. 14G is a conceptual diagram illustrating a method of driving the display panel 100A of FIG. 13 during a (P+6)-th frame.

The method of driving the display panel and the display apparatus according to an exemplary embodiment of the present invention may be substantially the same as the method of driving the display panel and the display apparatus described above with reference to FIGS. 1 to 9 except for the structure of the display panel and except that the gate driver operates a "six line skip" driving in a cycle of six frames. Thus, the same reference numerals may be used to refer to the same or like parts as those described in the previous exemplary embodiment of FIGS. 1 to 9 and any omitted description may be understood to be similar to or identical to corresponding elements that have been previously described.

Referring to FIGS. 1 to 14G, the display panel 100A includes a plurality of subpixels disposed in a matrix form. The display panel 100A may include a first subpixel having a first color, a second subpixel having a second color, and a third subpixel having a third color. For example, the first color may be red R. For example, the second color may be green G. For example, the third color may be blue B.

According to an exemplary embodiment of the present invention, the subpixels having the same color are disposed along a row direction and the first subpixel having the first color R, the second subpixel having the second color G, and the third subpixel having the third color B are alternately disposed along a column direction in the display panel 100A.

The display panel 100A is driven in "six line skip" driving. During the P-th frame, gate signals applied to a first group of gate lines are deactivated. During the (P+1)-th frame, gate signals applied to a second group of gate lines are deactivated. During the (P+2)-th frame, gate signals applied to a third group of gate lines are deactivated. During the (P+3)-th frame, gate signals applied to a fourth group of gate lines are deactivated. During the (P+4)-th frame, gate signals applied to a fifth group of gate lines are deactivated. During the (P+5)-th frame, gate signals applied to a sixth group of gate lines are deactivated. During the (P+6)-th frame, gate signals applied to the first group of gate lines are deactivated the same as during the P-th frame.

For example, the first group of gate lines may be (6M−5)-th gate lines. Herein, M is a positive integer. The first group of gate lines may include the first gate line GL1 and the seventh gate line GL7.

For example, the second group of gate lines may be (6M−4)-th gate lines. The second group of gate lines may include the second gate line GL2 and the eighth gate line GL5.

For example, the third group of gate lines may be (6M−3)-th gate lines. The third group of gate lines may include the third gate line GL3 and the ninth gate line GL9.

For example, the fourth group of gate lines may be (6M−2)-th gate lines. The fourth group of gate lines may include the fourth gate line GL4 and the tenth gate line GL10.

For example, the fifth group of gate lines may be (6M−1)-th gate lines. The fifth group of gate lines may include the fifth gate line GL5 and the eleventh gate line GL11.

For example, the fifth group of gate lines may be 6M-th gate lines. The sixth group of gate lines may include the sixth gate line GL6 and the twelfth gate line GL12.

The number of the first group of gate lines may be less than a half of the number of all gate lines of the display panel 100A. The number of the second group of gate lines may be less than a half of the number of all gate lines of the display panel 100A. The number of the third group of gate lines may be less than a half of the number of all gate lines of the display panel 100A. The number of the fourth group of gate lines may be less than a half of the number of all gate lines of the display panel 100A. The number of the fifth group of gate lines may be less than a half of the number of all gate lines of the display panel 100A. The number of the sixth group of gate lines may be less than a half of the number of all gate lines of the display panel 100A.

For example, the number of the first group of gate lines, the number of the second group of gate lines, the number of the third group of gate lines, the number of the fourth group of gate lines, the number of the fifth group of gate lines and the number of the sixth group of gate lines may be substantially the same as one another.

According to an exemplary embodiment of the present invention, the number of the first group of gate lines may be ⅙ of all gate lines of the display panel 100A.

According to an exemplary embodiment of the present invention, the gate driver 300 operates the "six line skip" driving using the clock signal. As explained referring to FIGS. 5A to 5D and 8A to 8D, when the gate signals applied to the first group of gate lines are deactivated, the first group of the stages outputting the gate signals applied to the first group of gate lines are deactivated and the clock signal for generating the gate signals applied to the first group of gate lines may be deactivated.

Similar to FIG. 8A, when the first clock signal CK1 and the first inverted clock signal CKB1 are deactivated, the pulse widths of the second clock signal CK2 and the second inverted clock signal CKB2, the third clock signal CK3, the third inverted clock signal CKB3, the fourth clock signal CK4, the fourth inverted clock signal CKB4, the fifth clock signal CK5, the fifth inverted clock signal CKB5, the sixth clock signal CK6 and the sixth inverted clock signal CKB6 may be increased compared to the pulse width TA in the normal driving in FIG. 7. The number of the gate lines to be scanned is decreased by ⅚ so that the pulse widths of the second clock signal CK2 and the second inverted clock signal CKB2, the third clock signal CK3, the third inverted clock signal CKB3, the fourth clock signal CK4, the fourth inverted clock signal CKB4, the fifth clock signal CK5, the fifth inverted clock signal CKB5, the sixth clock signal CK6 and the sixth inverted clock signal CKB6 may be 6/5 times the pulse width TA of the clock signal in the normal driving in FIG. 7.

Each of the subpixels of the display panel 100A which are deactivated in the P-th frame may be red subpixels. Each of the subpixels of the display panel 100A which are deactivated in the (P+1)-th frame may be green subpixels. Each of the subpixels of the display panel 100A which are deactivated in the (P+2)-th frame may be blue subpixels. Accordingly, the display defect of color loss may be generated.

The method of applying the data voltage having the overdriving grayscale value in the previous frame of the skipped frame in the "gate line skip" driving explained above with reference to FIGS. 12A and 12B may be applied to the "six line skip" driving of the instant display panel. Thus, the display defect of color loss may be prevented.

According to exemplary embodiments of the present invention, the gate signals applied to some of the gate lines are deactivated by frames, a data charging time in a horizontal period may be reduced. Thus, the charging rate of the data voltage of the subpixel may be increased so that the display quality of the display panel 100 may be enhanced.

In addition, in the present frame, the overdriving grayscale value GO greater than the target grayscale value GT may be applied to the subpixel connected to the gate line which is skipped in the previous frame. Thus, the deterioration of the display quality due to the discharge of the data voltage may be prevented.

FIG. 15A is a conceptual diagram illustrating a method of driving the display panel 100A, according to an exemplary embodiment of the present invention, during a P-th frame. FIG. 15B is a conceptual diagram illustrating a method of driving the display panel 100A of FIG. 15A during a (P+1)-th frame. FIG. 15C is a conceptual diagram illustrating a method of driving the display panel 100A of FIG. 15A during a (P+2)-th frame. FIG. 15D is a conceptual diagram illustrating a method of driving the display panel 100A of FIG. 15A during a (P+3)-th frame.

The method of driving the display panel and the display apparatus may be substantially the same as the method of driving the display panel and the display apparatus described above with reference to FIGS. 13 to 14G except that the 2 adjacent gate lines are simultaneously skipped in a cycle of three frames. Thus, the same reference numerals may be used to refer to the same or like parts as those described above with reference to FIGS. 13 to 14G and any omitted description may be understood to be identical to, or similar to corresponding elements that have been previously described.

Referring to FIGS. 1 to 15D, the display panel 100A includes a plurality of subpixels disposed in a matrix form. The display panel 100A may include a first subpixel having a first color, a second subpixel having a second color, and a third subpixel having a third color. For example, the first color may be red R. For example, the second color may be green G. For example, the third color may be blue B.

According to an exemplary embodiment of the present invention, the subpixels having the same color are disposed along a row direction and the first subpixel having the first color R, the second subpixel having the second color G, and the third subpixel having the third color B are alternately disposed along a column direction in the display panel 100A.

Two adjacent gate lines of the display panel 100A form a pair and the display panel 100A is driven in "six line skip" driving. During the P-th frame, gate signals applied to a first group of gate lines are deactivated. During the (P+1)-th frame, gate signals applied to a second group of gate lines are deactivated. During the (P+2)-th frame, gate signals applied to a third group of gate lines are deactivated. During the (P+3)-th frame, gate signals applied to the first group of gate lines are deactivated the same as during the P-th frame.

For example, the first group of gate lines may include (6M−5)-th gate lines and (6M−4)-th gate lines. Herein, M is a positive integer. The first group of gate lines may include the first gate line GL1, the second gate line GL2, the seventh gate line GL7, and the eighth gate line GL8.

For example, the second group of gate lines may include (6M−3)-th gate lines and (6M−2)-th gate lines. The second group of gate lines may include the third gate line GL3, the fourth gate line GL4, the ninth gate line GL9, and the tenth gate line GL10.

For example, the third group of gate lines may include (6M−1)-th gate lines and 6M-th gate lines. The third group of gate lines may include the fifth gate line GL5, the sixth gate line GL6, the eleventh gate line GL11, and the twelfth gate line GL12.

The number of the first group of gate lines may be less than a half of the number of all gate lines of the display panel 100A. The number of the second group of gate lines may be less than a half of the number of all gate lines of the display panel 100A. The number of the third group of gate lines may be less than a half of the number of all gate lines of the display panel 100A.

For example, the number of the first group of gate lines, the number of the second group of gate lines, and the number of the third group of gate lines may be substantially the same as one another.

According to exemplary embodiments of the present invention, the number of the first group of gate lines may be ⅓ of all gate lines of the display panel 100A.

The subpixels of the display panel 100A which are deactivated in the P-th frame may be red and green subpixels, the subpixels of the display panel 100A which are deactivated in the (P+1)-th frame may be blue and red subpixels, and the subpixels of the display panel 100A which are deactivated in the (P+2)-th frame may be green and blue subpixels so that the display defect of color loss may be generated.

The method of applying the data voltage having the overdriving grayscale value in the previous frame of the skipped frame in the "gate line skip" driving explained above with reference to FIGS. 12A and 12B may be applied to the "two line pair skip" driving described above. Thus, the display defect of color loss may be prevented.

According to exemplary embodiments of the present invention, the gate signals applied to some of the gate lines are deactivated according to the frames, a data charging time in a horizontal period may be reduced. Thus, the charging rate of the data voltage of the subpixel may be increased so that the display quality of the display panel 100 may be enhanced.

In addition, in the present frame, the overdriving grayscale value GO greater than the target grayscale value GT may be applied to the subpixel connected to the gate line which is skipped in the previous frame. Thus, the deterioration of the display quality due to the discharge of the data voltage may be prevented.

According to exemplary embodiments of the present invention, the charging rate of the data voltage applied to the subpixel may be increased so that the display quality of the display panel may be enhanced.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from the novel teachings and aspects of the present inventive concept. Accordingly, all such modifications are intended to be included within the scope of the present inventive concept.

What is claimed is:

1. A display apparatus, comprising:

a display panel comprising a plurality of gate lines, a plurality of data lines, and a plurality of subpixels, each of the plurality of subpixels including a subpixel electrode connected to one of the plurality of gate lines and one of the plurality of data lines through a switching element such that each of the plurality of subpixels is associated with a gate line of the plurality of gate lines and a data line of the plurality of data lines;

a gate driver configured to output a plurality of gate signals to the plurality of gate lines and to deactivate at least one of the plurality of gate signals in a P-th frame; and a data driver configured to output a plurality of data voltages to the plurality of data lines, wherein P is a positive integer, and wherein subpixels of the plurality of subpixels that are associated with the gate lines that have the deactivated gate signals are overdriven with overdriving data signals in a (P−1)th frame.

2. The display apparatus of claim 1, wherein the overdriving data signals have an overdriving grayscale value that is greater than a target grayscale value.

3. The display apparatus of claim 1, wherein the gate driver comprises a plurality of stages, wherein each of the plurality of stages are connected at least one clock line, and wherein a clock signal inputted to a stage connected to the gate line to which the at least one gate signal is deactivated in the P-th frame, is deactivated.

4. The display apparatus of claim 1, wherein the at least one gate signal which is deactivated in the P-th frame is activated in a (P+K)-th frame, wherein at least one of the gate signals, of the plurality of gate signals, which are not deactivated in the P-th frame are deactivated in the (P+K)-th frame, and wherein K is a positive integer.

5. The display apparatus of claim 1, wherein a number of the gate lines of which the gate signals are deactivated in the P-th frame is less than a half of a total number of the gate lines of the display panel.

6. The display apparatus of claim 1, wherein the gate driver is configured to deactivate gate signals, of the plurality of gate signals, that are applied to a first group of gate lines, of the plurality of gate lines, in the P-th frame, deactivate gate signals, of the plurality of gate signals, that are applied to a second group of gate lines, of the plurality of gate lines, in a (P+1)-th frame, and deactivate gate signals, of the plurality of gate signals, that are applied to a third group of gate lines, of the plurality of gate lines, in a (P+2)-th frame.

7. The display apparatus of claim 6, further comprising a timing controller configured to deactivate a first clock signal for generating the gate signals applied to the first group of the gate lines, deactivate a second clock signal for generating the gate signals applied to the second group of the gate lines, and deactivate a third clock signal for generating the gate signals applied to the third group of the gate lines.

8. The display apparatus of claim 6, wherein the display panel includes a first subpixel having a first color, a second subpixel having a second color, and a third subpixel having a third color, that are alternately disposed along a row direction in the display panel, and wherein subpixels having a same color are disposed along a column direction in the display panel.

9. The display apparatus of claim 8, wherein the first group of the gate lines are connected to (3M−2)-th subpixel rows, wherein the second group of the gate lines are connected to (3M−1)-th subpixel rows, wherein the third group of the gate lines are connected to 3M-th subpixel rows, and M is a positive integer.

10. The display apparatus of claim 8, wherein the gate driver is configured to deactivate gate signals applied to a fourth group of gate lines, of the plurality of gate lines, in a (P+3)-th frame, wherein each of the gate lines of the first group of the gate lines are connected to (4M−3)-th subpixel rows, wherein each of the gate lines of the second group of the gate lines are connected to (4M−2)-th subpixel rows, wherein each of the gate lines of the third group of the gate lines are connected to (4M−1)-th subpixel rows, wherein each of the gate lines of the fourth group of the gate lines are connected to 4M-th subpixel rows, and M is a positive integer.

11. The display apparatus of claim 6, wherein in each of the plurality of pixels, subpixels having a same color are disposed along a row direction in the display panel, and wherein the display panel includes a first subpixel having a first color, a second subpixel having a second color, and a third subpixel having a third color are alternately disposed along a column direction in the display panel.

12. The display apparatus of claim 11, wherein the gate driver is configured to deactivate gate signals, of the plurality of gate signals, applied to a fourth group of gate lines, of the plurality of gate lines, in a (P+3)-th frame, deactivate gate signals, of the plurality of gate signals, applied to a fifth group of gate lines, of the plurality of gate lines, in a (P+4)-th frame, and deactivate gate signals, of the plurality of gate signals, applied to a sixth group of gate lines, of the plurality of gate lines, in a (P+5)-th frame, wherein the first group of the gate lines are connected to (6M−5)-th subpixel rows, wherein the second group of the gate lines are connected to (6M−4)-th subpixel rows, wherein the third group of the gate lines are connected to (6M−3)-th subpixel rows, wherein the fourth group of the gate lines are connected to (6M−2)-th subpixel rows, wherein the fifth group of the gate lines are connected to (6M−1)-th subpixel rows, wherein the sixth group of the gate lines are connected to 6M-th subpixel rows, and wherein M is a positive integer.

13. The display apparatus of claim 11, wherein the first group of the gate lines are connected to (6M−5)-th subpixel rows and (6M−4)-th subpixel rows, wherein the second group of the gate lines are connected to (6M−3)-th subpixel rows and (6M−2)-th subpixel rows, wherein the third group of the gate lines are connected to (6M−1)-th subpixel rows and 6M-th subpixel rows, and M is a positive integer.

14. The display apparatus of claim 6, wherein the data driver is configured to apply data voltages, of the plurality of data voltages, having overdriving grayscale values that are greater than target grayscale values that are applied to subpixels connected to the first group of the gate lines in a (P−1)-th frame, to apply data voltages, of the plurality of data voltages, having overdriving grayscale values that are greater than target grayscale values that are applied to subpixels connected to the second group of the gate lines in the P-th frame, and to apply data voltages, of the plurality of data voltages, having overdriving grayscale values that are greater than target grayscale values that are applied to subpixels connected to the third group of the gate lines in the (P+1)-th frame.

15. The display apparatus of claim 6, further comprising a timing controller configured to determine a driving mode of the gate driver based on input image data, wherein when the driving mode is determined to be in a first mode, the gate driver is configured to activate each of the gate lines in the P-th frame, the (P+1)-th frame and the (P+2)-th frame, and wherein when the driving mode is determined to be in a second mode, the gate driver is configured to deactivate the first group of the gate lines in the P-th frame, deactivate the second group of the gate lines in the (P+1)-th frame, and deactivate the third group of the gate lines in the (P+2)-th frame.

16. The display apparatus of claim 15, wherein when a difference between input image data of a previous frame and input image data of a present frame is greater than a predetermined threshold, the timing controller determines that the driving mode is in the first mode, and wherein when the difference between the input image data of the previous frame and the input image data of the present frame is equal to or less than the predetermined threshold, the timing controller determines that the driving mode is in the second mode.

17. The display apparatus of claim 15, wherein a pulse width of the gate signal in the second mode is greater than a pulse width of the gate signal in the first mode.

18. The display apparatus of claim 17, wherein when a number of the first group of the gate lines is ⅓ of a total number of the gate lines of the display panel, the pulse width of the gate signal in the second mode is 3/2 times the pulse with of the gate signal in the first mode.

19. The display apparatus of claim 17, wherein when a number of the first group of the gate lines is ¼ of a number of each of the gate lines of the display panel, the pulse width of the gate signal in the second mode is 4/3 times the pulse with of the gate signal in the first mode.

20. A method of driving a display panel, the method comprising:

driving a first group of pixels at target grayscale values in a (P−1)th frame;

driving a second group of pixels at overdriving grayscale values that are greater than the target grayscale values in the (P−1)th frame;

driving the first group of pixels at target grayscale values in a P-th frame; and deactivating the second group of pixels in the P-th frame, wherein each pixel of the second group of pixels is associated with a particular set of gate lines, and wherein P is a positive integer.

21. The method of claim 20, wherein the particular set of gate lines changes from frame-to-frame.

* * * * *